US012778273B2

(12) United States Patent
Peoples et al.

(10) Patent No.: US 12,778,273 B2
(45) Date of Patent: Nov. 3, 2026

(54) LOCKING CLIP FOR PERSONAL ELECTRONIC DEVICE

(71) Applicant: MSA Technology, LLC, Cranberry Township, PA (US)

(72) Inventors: Bryan J. Peoples, Baden, PA (US); Zachary William Miller, Mt. Washington, PA (US); Jason Paul Eaton, Hunker, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 46 days.

(21) Appl. No.: 18/630,175

(22) Filed: Apr. 9, 2024

(65) Prior Publication Data

US 2025/0311839 A1 Oct. 9, 2025

(51) Int. Cl.
*A45F 5/02* (2006.01)
*A45F 5/00* (2006.01)

(52) U.S. Cl.
CPC ..... *A45F 5/021* (2013.01); *A45F 5/022* (2013.01); *A45F 5/1508* (2025.01); *A45F 5/1516* (2025.01); *A45F 5/1525* (2025.01)

(58) Field of Classification Search
CPC ..... A45F 5/021; A45F 5/022; A45F 5/1525; A45F 5/1516; A45F 5/1508; A45F 5/02
See application file for complete search history.

(56) References Cited

U.S. PATENT DOCUMENTS 2,397,780 A * 4/1946 Emde ..... H04R 25/04 24/3.11
3,808,642 A 5/1974 Nation
4,780,934 A * 11/1988 Vickers ..... G08B 3/1058 24/3.11
5,081,709 A * 1/1992 Benyo ..... H04B 1/088 224/679
5,361,459 A * 11/1994 Hyvonen ..... G08B 3/1058 24/66.8
6,283,348 B1 * 9/2001 Wang ..... G08B 3/1058 24/3.12
9,510,662 B1 * 12/2016 Bruns ..... A45F 5/02
9,872,954 B2 * 1/2018 Crane ..... A45F 5/021
10,449,291 B2 * 10/2019 Hadian ..... A61M 5/1415
2002/0083558 A1 7/2002 Tsou
(Continued)

FOREIGN PATENT DOCUMENTS

GB 2226073 A * 6/1990 ..... G08B 3/1058
JP H06177810 A * 6/1994

OTHER PUBLICATIONS

Patent Cooperation Treaty; PCT/US2025/010929; International Search Report and Written Opinion; Mar. 24, 2025.

*Primary Examiner* — William L Miller
(74) *Attorney, Agent, or Firm* — Jones Day

(57) ABSTRACT

Devices and methods are provided for an attachment clip with a locking member, the attachment clip providing a secure connection between an object and a device, such as a portable communication device. The attachment clip may be configured to pivot on an axis between a closed position and an open position with a spring configured to apply a torque to return the attachment clip to the closed position. Once a device has been secured and the attachment clip is in the closed position, a locking member may enter a locked position and thereby prevent the attachment clip from inadvertently pivoting to the open position.

17 Claims, 36 Drawing Sheets

(56) References Cited

U.S. PATENT DOCUMENTS

| | | | | |
|---|---|---|---|---|
| 2003/0047575 | A1* | 3/2003 | Enkerlin | A45F 5/02 224/196 |
| 2003/0106917 | A1* | 6/2003 | Shetler | A45F 5/02 224/269 |
| 2003/0162510 | A1 | 8/2003 | Kim | |
| 2006/0283898 | A1 | 12/2006 | Tages | |
| 2007/0278270 | A1* | 12/2007 | Castaneda | A45F 5/00 224/269 |
| 2013/0126565 | A1* | 5/2013 | Rostami | G06F 1/1632 224/191 |
| 2016/0256623 | A1 | 9/2016 | Crane et al. | |
| 2017/0122701 | A1* | 5/2017 | Lim | H04B 1/3888 |
| 2018/0064868 | A1* | 3/2018 | Hadian | A45F 5/02 |
| 2022/0031053 | A1* | 2/2022 | Briggs | A45F 5/02 |
| 2023/0225489 | A1 | 7/2023 | Gostev | |

* cited by examiner

LOCKING CLIP FOR PERSONAL ELECTRONIC DEVICE

BACKGROUND

Communication devices play a critical role in ensuring effective and efficient communication between individuals conducting various tasks, including emergency responders (e.g., firefighters, paramedics). For example, emergency responders will often utilize communications devices for real-time communication and coordination among team members, enabling them to share vital information, coordinate their actions, and make informed decisions in the field. In many such emergency situations, clear and reliable communication is paramount for the safety and success of the emergency response operations. Often, communication devices will be used to provide a lifeline for emergency responders operating in hazardous environments. To provide easy access, emergency responder communication devices may be attachable to the emergency responder's equipment or clothing. Many other electronic devices may also be attached to a user, including pager systems, two-way radios, and cellular devices. Such devices may be useful in a variety of applications beyond emergency response operations, including for use in hospital settings, combat situations, law enforcement scenarios, and the like.

SUMMARY

Systems and methods are provided for a device attachment clips with locking features. For instance, in various aspects a locking member of the attachment clip may selectively contact or otherwise engage with a second member or the attached object (e.g., electronics device) itself to prevent the attachment clip from opening. In this manner, the attachment clips described herein may remain securely attached to an object until a user chooses to disengage the locking member and then remove the attachment clip. In order to ensure easy attachment and detachment, the locking member and the attachment clip may be designed to both and unlock and open based on a single point of contact. Such an arrangement may permit a user to easily unlock the attachment clip using a single hand. Furthermore, the locking member and the attachment clip may be configured to return to locked and closed positions without user action, such as through the spring force of one or more springs. As will be further discussed, these are only a few of the advantages that the present disclosure provides, and a skilled artisan will readily recognize further benefits to employing the systems and methods described herein.

In one aspect, the present disclosure provides an attachment clip. The attachment clip may include a first member configured to pivot on an axis between a closed position and an open position. The attachment clip may also include a spring coupled to the first member and configured to apply a torque to rotate the first member toward the closed position. The attachment clip may further include a locking member coupled to the first member and configured to move from an unlocked position to a locked position when the first member is in the closed position, the first member being prevented from pivoting to the open position when the locking member is in the locked position.

In another aspect, the present disclosure provides an attachment clip. The attachment clip may include a first member having a top surface, a first end, and a second end. The first member may be configured to pivot on an axis between a closed position and an open position. The attachment clip may also include a spring coupled to the first member and configured to apply a torque to rotate the first member toward the closed position. The attachment clip may further include a locking member coupled to the first end of the first member and configured to rotate from an unlocked position to a locked position, wherein the locking member is substantially perpendicular to the top surface of the first member when in the locked position.

In yet another aspect, the present disclosure provides an attachment clip. The attachment clip may include a first member having a first end and a second end. The first member may be configured to pivot on an axis between a closed position and an open position. The attachment clip may also include a spring coupled to the first member and configured to apply a torque to rotate the first member toward the closed position. The attachment clip may further include a second member, the second member including a protrusion having a bottom surface. Further yet, the attachment clip may include a locking member coupled to the second end of the first member and configured to slide from an unlocked position to a locked position, wherein the locking member includes a locking protrusion with a top surface, and wherein the top surface of the locking protrusion is opposed to the bottom surface of the protrusion of the second member when the locking member is in a locked position.

In another aspect, the present disclosure provides a method of securing an attachment clip. The method may include pivoting a first member from a closed position to an open position, wherein a spring may be coupled to the first member and configured to apply a torque to rotate the first member toward the closed position. The method may also include positioning the first member to at least partially enclose a portion of an object, pivoting the first member from the open position to the closed position, and moving a locking member from an unlocked position to a locked position. The first member may specifically be prevented from pivoting to the open position when the locking member is in a locked position.

The current subject matter will be better understood by reference to the following detailed description when considered in combination with the accompanying drawings which form part of the present specification.

BRIEF DESCRIPTION OF DRAWINGS

FIG. 3A is a diagram depicting a side view of the attachment clip of FIGS. 2A-2F in a closed position and an object for the attachment clip to be secured to.

FIG. 5A is a diagram depicting a side view of the attachment clip of FIGS. 4A-4F in a closed position and an object for the attachment clip to be secured to.

DETAILED DESCRIPTION

Figure 1A:
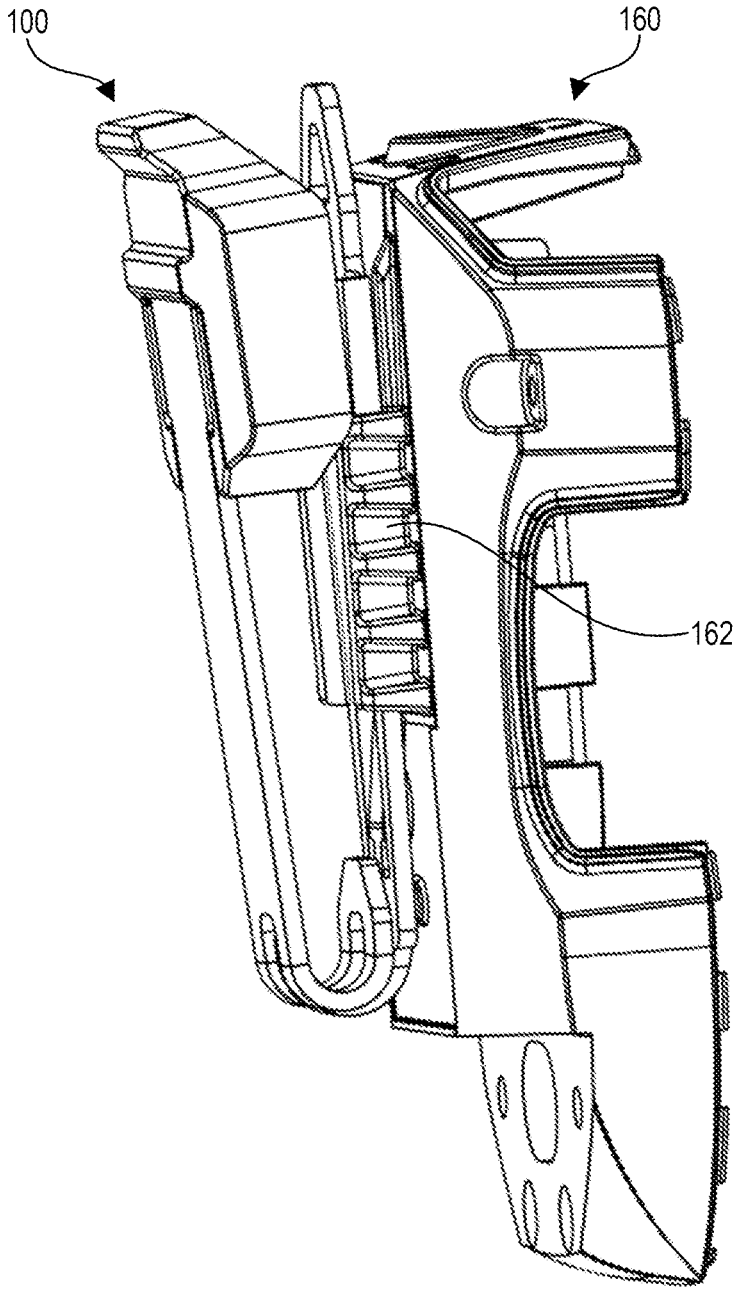
FIG. 1A is a diagram depicting a perspective view of an attachment clip connected to a shell portion of an electronics device.

The following disclosure provides many different aspects, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include aspects in which the first and second features are formed in direct contact, and may also include aspects in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various aspects and/or configurations discussed.

As described above, electronic communication devices often include an attachment component to help secure the device to a user. These attachment components may be spring-loaded clips that are opened by hand, with a spring force based on the strength of the acting spring used to close the clip and hold it in place. A spring-loaded device attachment clip may include a stationary body (sometimes integrated to the device enclosure), a movable clip body, and a spring. The movable clip body may rotate around a pin or pivoting axis positioned on the stationary clip base or the communication device. This axis may be shared with a torsion spring, which may be preloaded to hold the clip biased in a closed position. The movable clip body may include a clamping portion on one side of the axis (i.e., the distal side), and a tab portion on the opposite side of the axis (i.e., the proximal side). To open such an attachment clip, a user may press on the tab and pivot the movable clip body so that the clip opens. When the tab is released, the spring force may return the clip to a closed position. As an alternative to pressing down on the tab, a user may instead lift the clamping portion on the distal side, thereby opening the clip.

Unfortunately, the present disclosure recognizes that, while this method of clipping a device to a user provides versatility in where it may be attached as well as the ability to quickly move from one position to another, this kind of attachment is prone to becoming disconnected as the spring may open up inadvertently when the device is acted upon by an outside force. In such situations, the clip may open and the device may become disconnected from the attachment point. In other words, with a simple attachment clip design, any force on the clamping portion or the tab portion that acts in the clip-opening direction (e.g., a force that presses downward on the tab portion or which pulls the clamping portion upward) may also inadvertently open the clip and thereby cause the connected object to release from its mounting location on an object (e.g., belt, jacket, equipment strap, etc.). This can lead to loss or displacement of the device connected to the attachment clip, which can present a safety risk and/or financial loss to the user of the device. For instance, if the attachment clip is being used to attach a portable communications device to an emergency responder, and the attachment clip inadvertently disconnects, then the emergency responder may have no way of communicating with other responders. While increasing the spring force—and thereby the clamping force of the attachment device—may help to prevent inadvertent attachment when the clip is subjected to lesser detachment forces (e.g., snagging on environmental object), there is still a risk of detachment with a traditional clip design. Moreover, it is desirable for the spring force to remain small enough that a user may easily attach and detach an associated device. Indeed, one of the advantages of using a clip connection is the rapid attachment and detachment capabilities it provides compared to other attachment techniques, such as tying the device to the user.

In order to address the deficiencies associated with simple clip designs, the present disclosure provides, in part, systems and methods that utilize attachment clips that combine the traditional feature and function of a spring-loaded clip, with a locking feature to hold the clip in a closed position when installed over attachment points of certain shapes and sizes. Accordingly, the attachment clips described herein may provide the versatility and speed of a spring-loaded clip, but also produce a secure attachment as a result of the locking feature. In some aspects, attachment clips are provided that allow two different attachment levels: a less-secure spring-loaded attachment for less-critical scenarios, and a highly-secure locked attachment for more rugged or severe scenarios. For example, an emergency responder wearing a portable communications device around a fire station may only need the strength of a spring-loaded clip to maintain a device on a pocket flap. But when that user puts on turnout gear and other protective equipment and enters a structural fire, a more secure means of attaching the device may be desired to avoid loss or damage to the device. The locking option on the attachment clip may give the user the option of placing the device on a strap, loop of fabric, or similar mounting location where the clip can lock, thereby forming a secure attachment. In some aspects, the locked attachment clip may form an enclosed slot from which a strap, loop of fabric, or mounting structure cannot escape until the attachment clip is unlocked and intentionally opened.

Although the example systems and methods discussed herein are often described in relation to portable emergency responder communications devices, a skilled artisan should readily appreciate that the configurations and techniques described herein can be applied to other devices and applications, including but not limited to, communication devices (e.g., cellular phones, two-way radios, pagers), other personal electronics (e.g., tablets, cameras, speakers, calculators), personal safety equipment (e.g., fall harnesses, portable gas detectors, portable Geiger counters, clip on mace cannisters, etc.), or any other similar device or application that may benefit from a more-secure clip attachment.

Figure 1B:
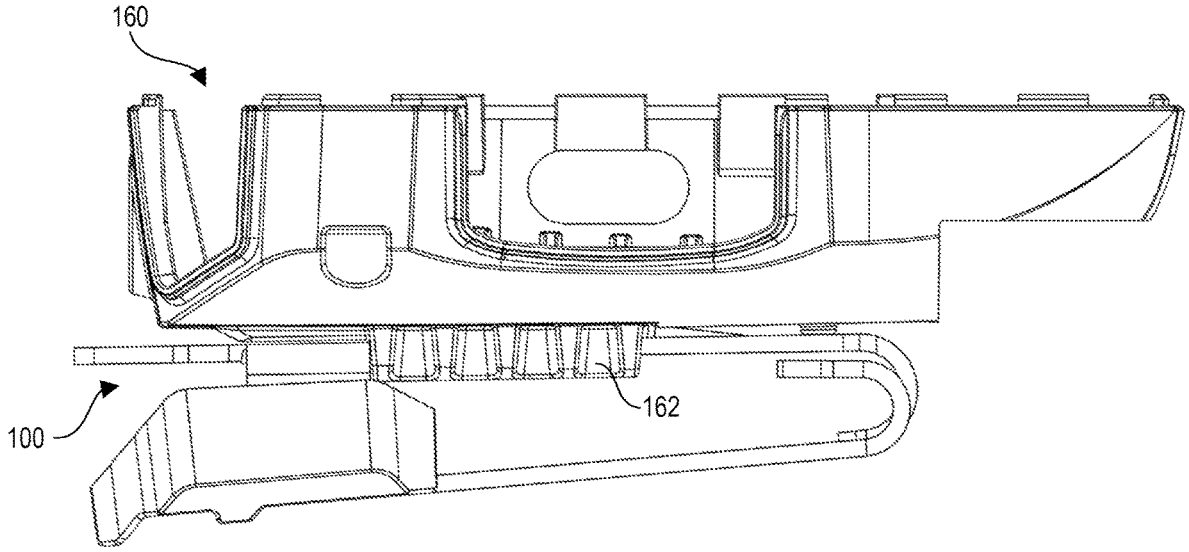
FIG. 1B is a diagram depicting a side view of the attachment clip and electronics device of FIG. 1A.
Figure 1C:
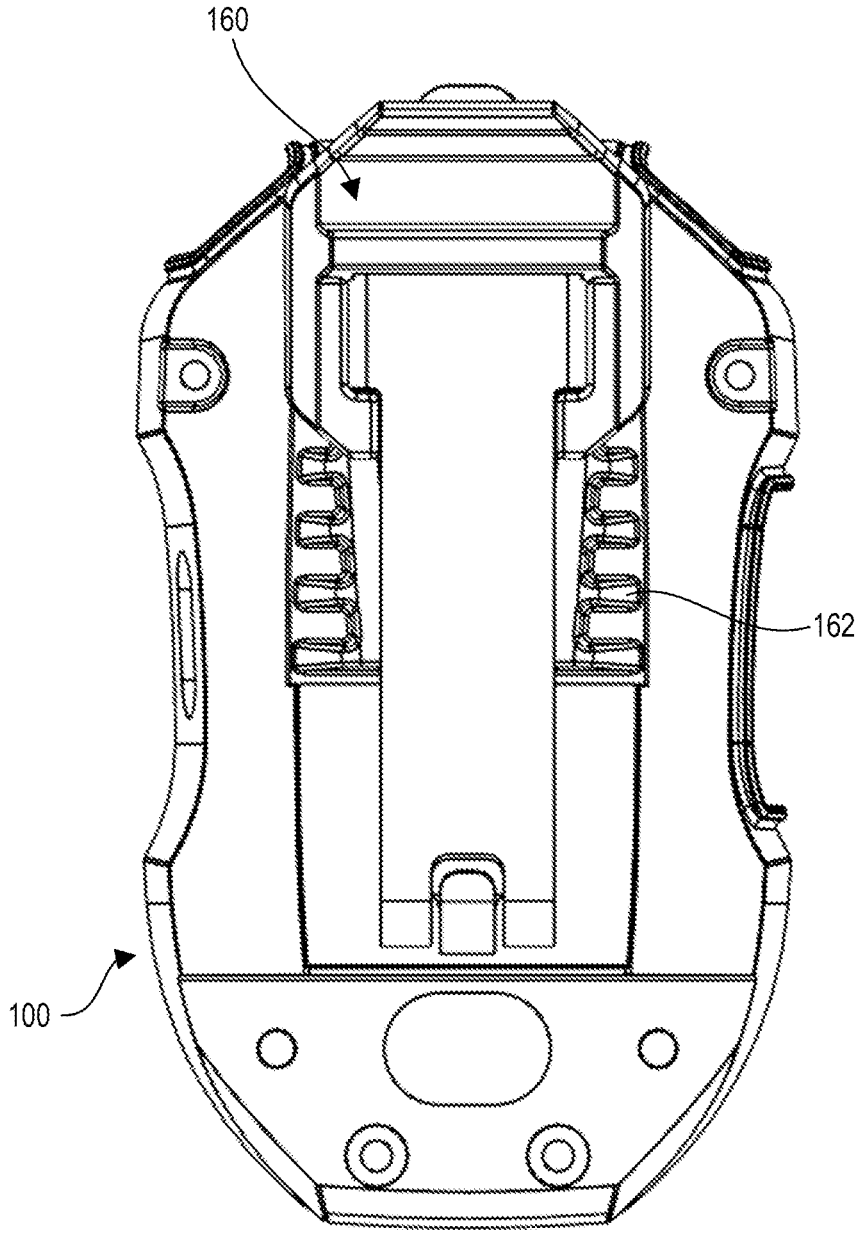
FIG. 1C is a diagram depicting a front view of the attachment clip and electronics device of FIGS. 1A-1B.
Figure 2A:
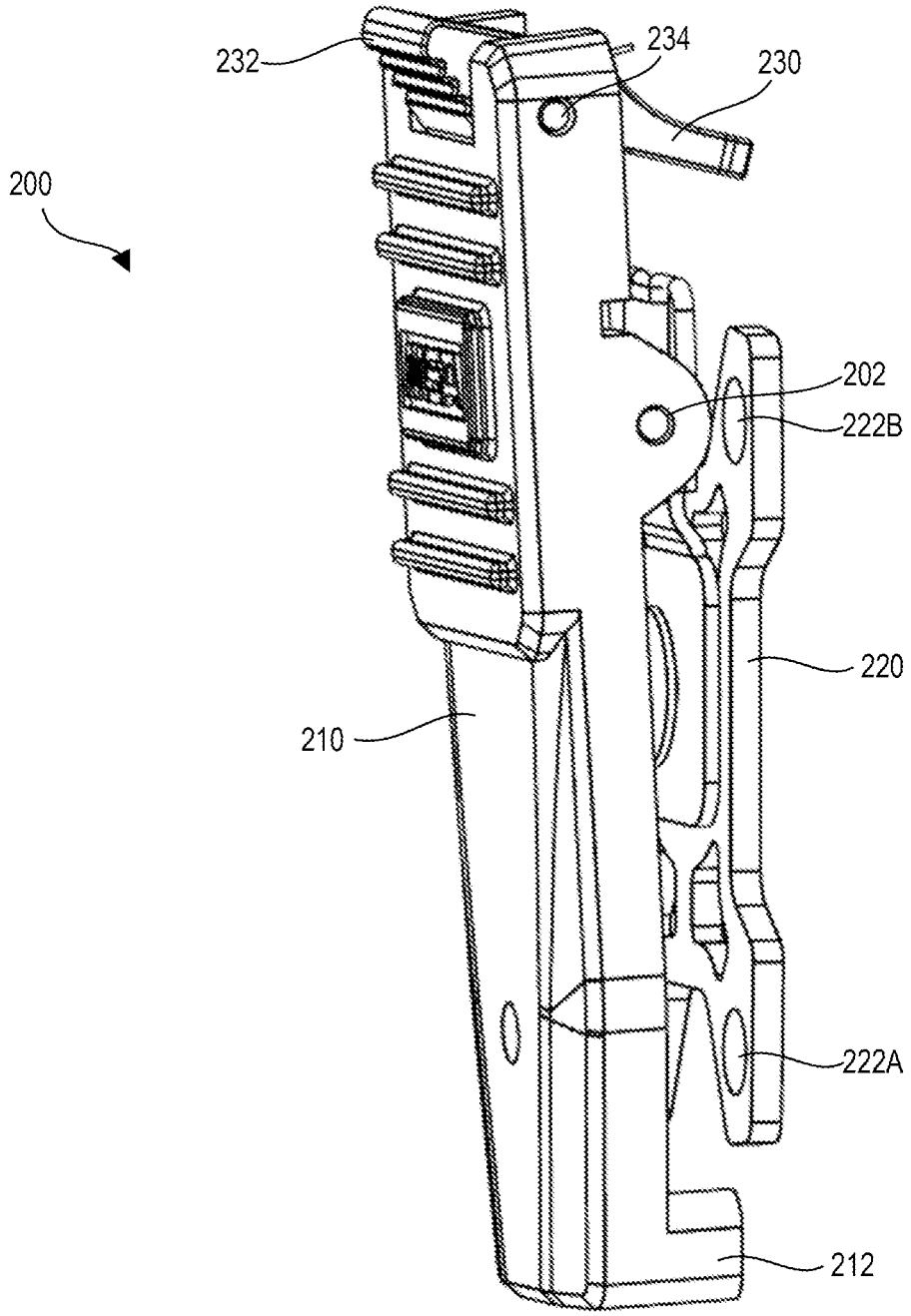
FIG. 2A is a diagram depicting a front, perspective view of an attachment clip having a rotating locking member.
Figure 2B:
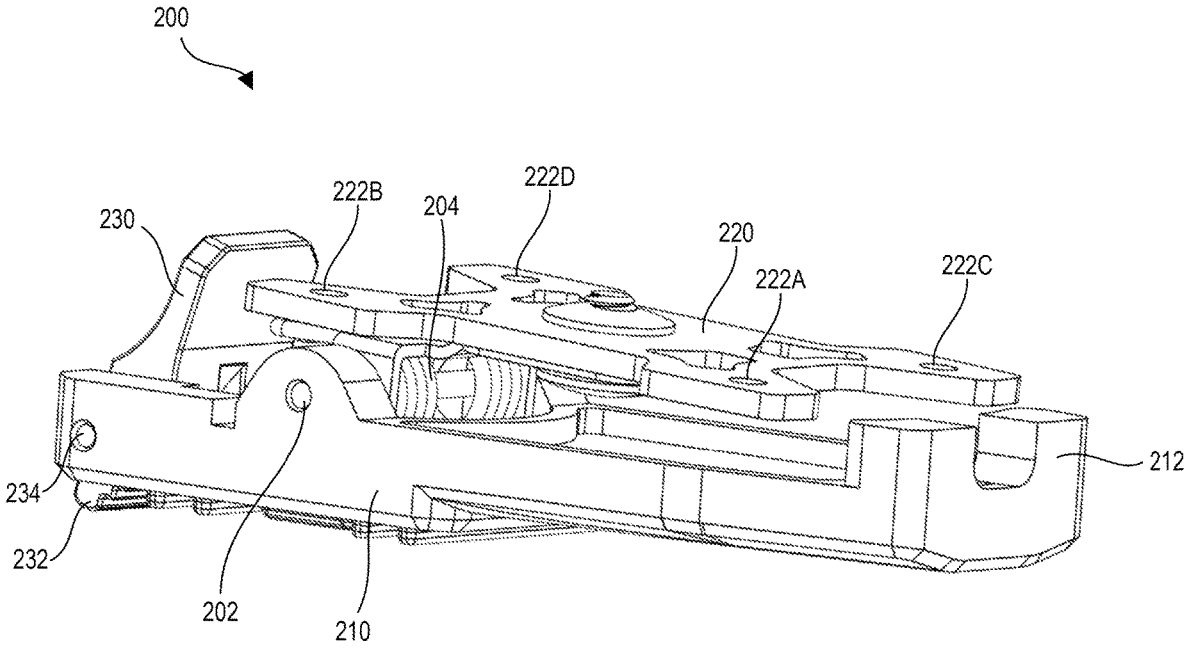
FIG. 2B is a diagram depicting a rear, perspective view of the attachment clip of FIG. 2A.
Figure 2C:
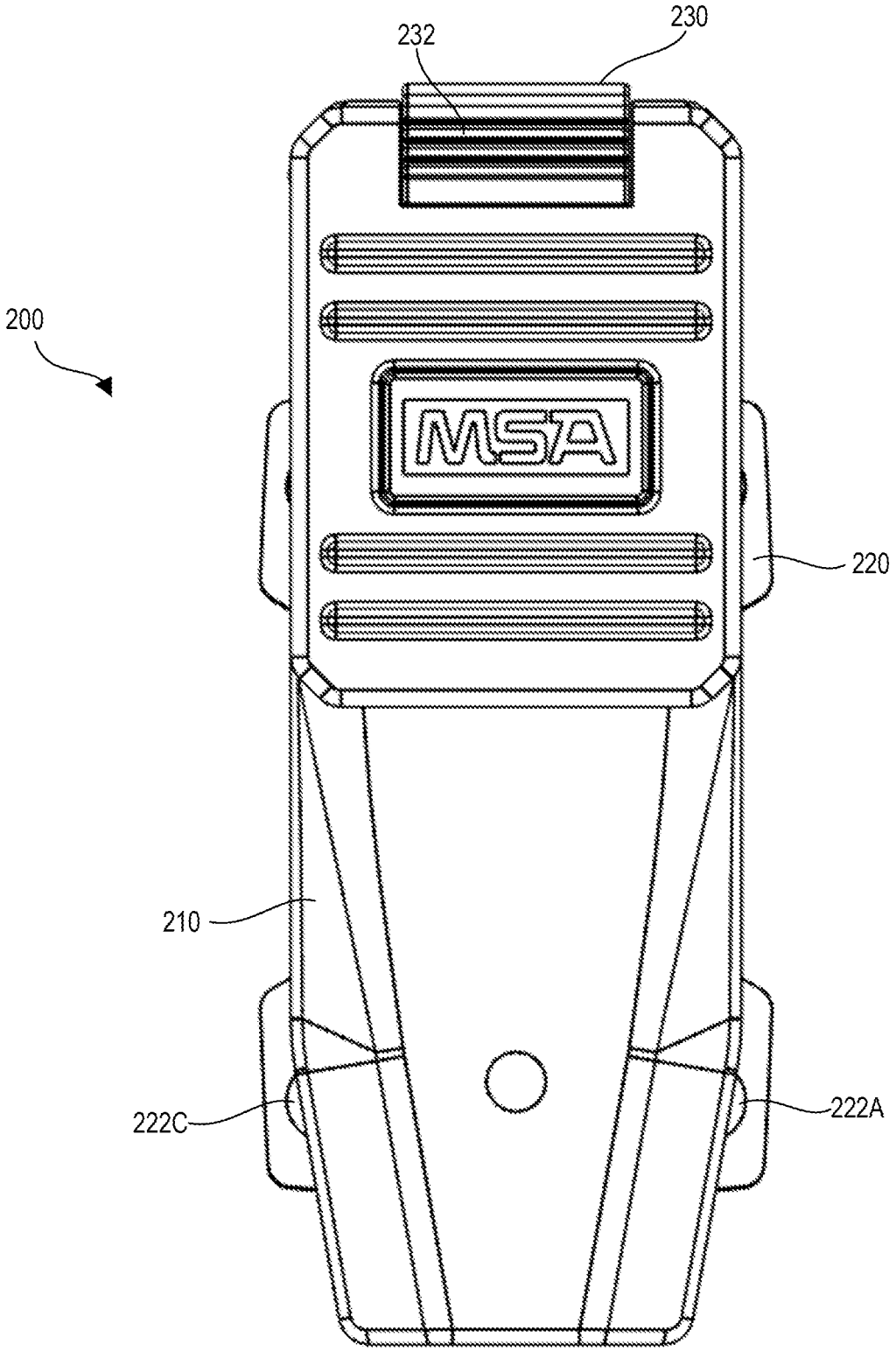
FIG. 2C is a diagram depicting a front view of the attachment clip of FIGS. 2A-2B.
Figure 2D:
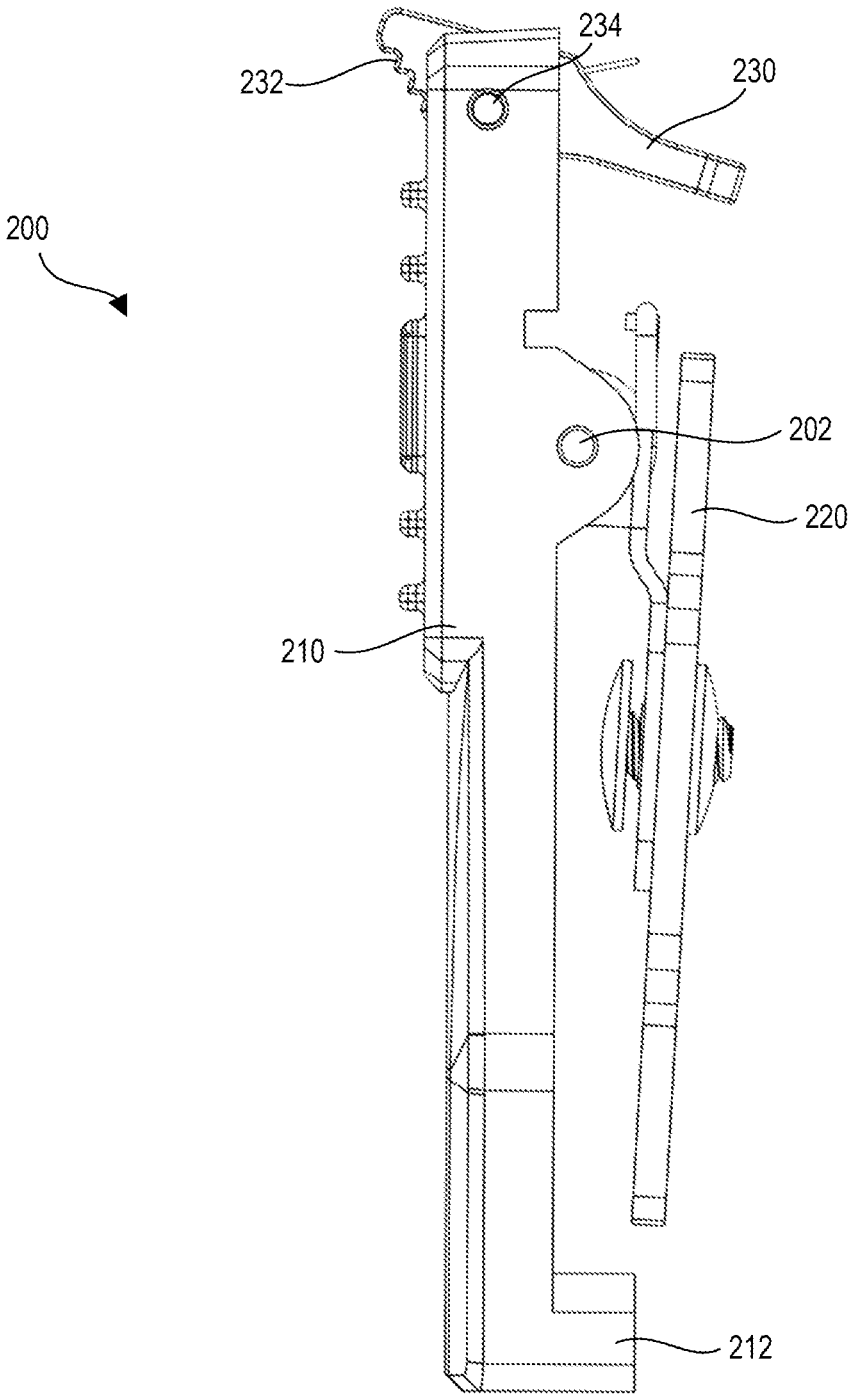
FIG. 2D is a diagram depicting a side view of the attachment clip of FIGS. 2A-2C.
Figure 2E:
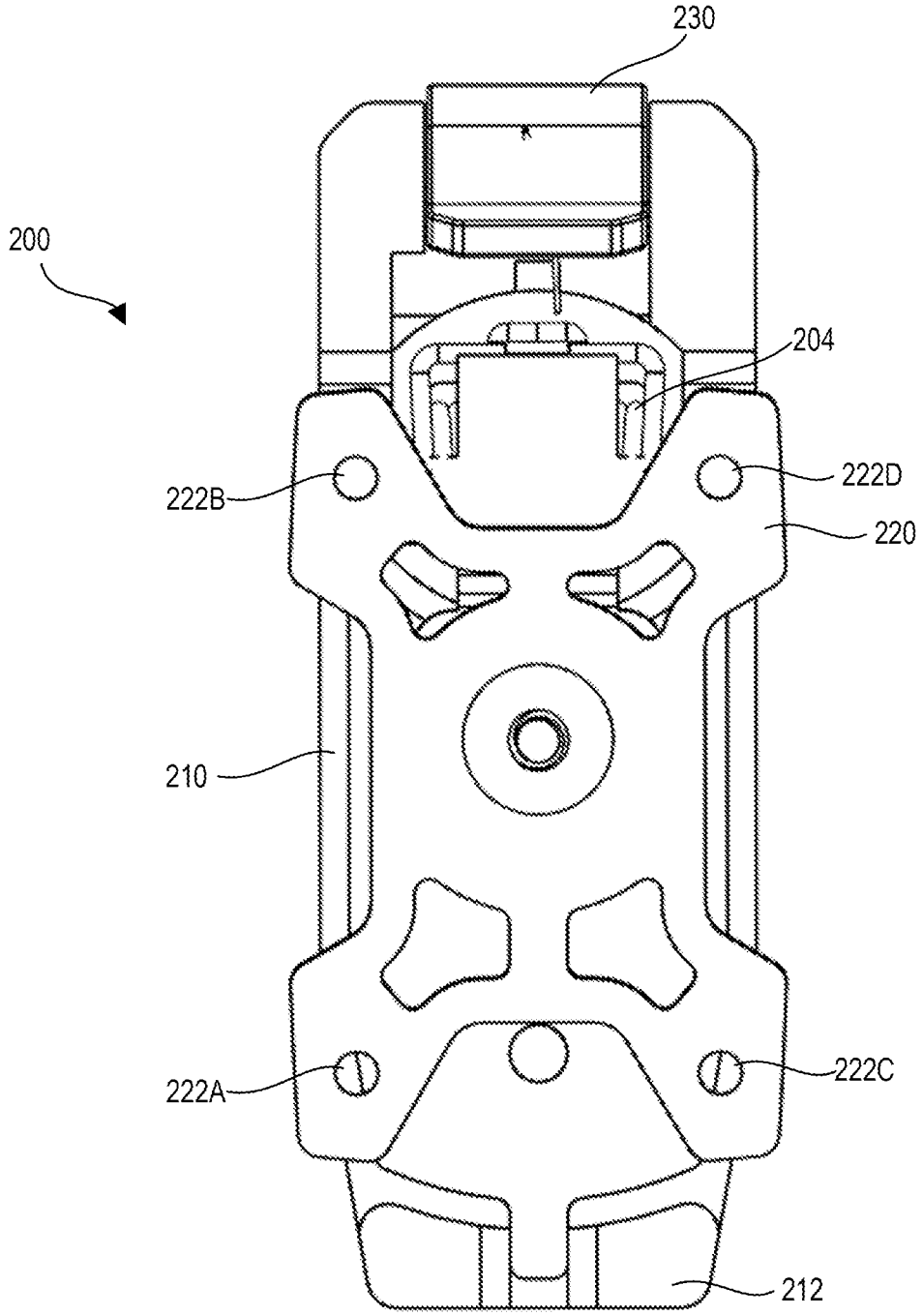
FIG. 2E is a diagram depicting a rear view of the attachment clip of FIGS. 2A-2D.
Figure 2F:
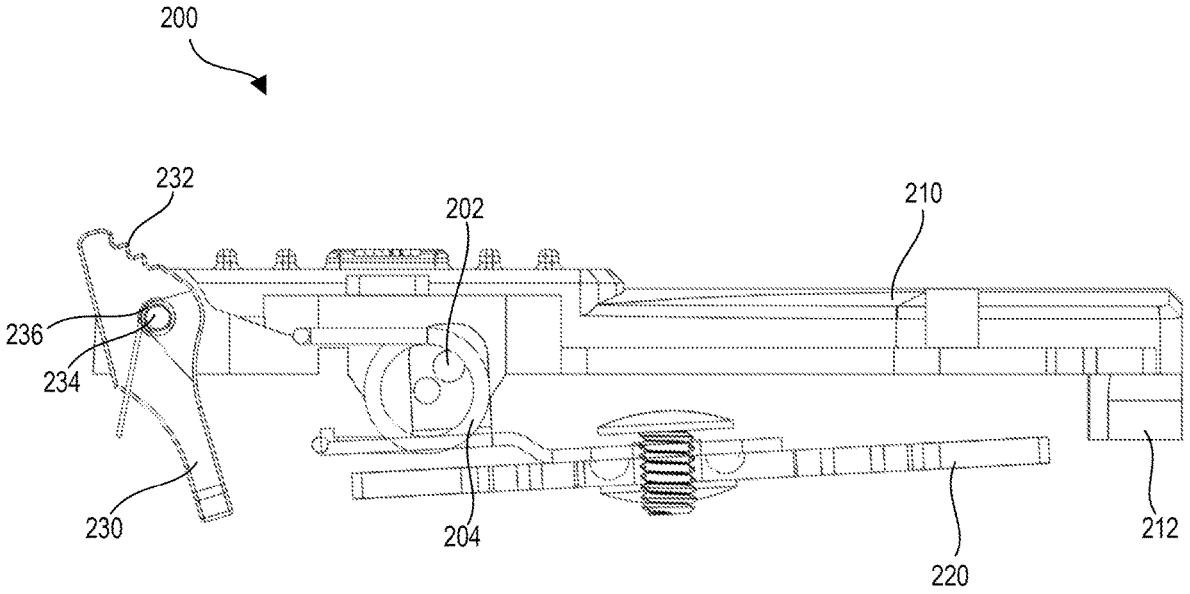
FIG. 2F is a diagram depicting a side, sectional view of attachment clip of FIGS. 2A-2E.

FIGS. 1A-1C depict various views of an attachment clip 100 connected to a shell portion 160 of an electronics device (full device not depicted). As described above, the attachment clip 100 may generally function to permit a user to attach the electronics device to an object, such as a jacket sleeve, a belt, an equipment strap, a shirt pocket, or any comparable object to which the attachment clip 100 may be secured to. In order to provide this attachment functionality to the electronics device, the attachment clip 100 may be specifically configured to attach to the electronics device, and/or the electronics device may be specifically configured to attach to the attachment clip 100. For instance, as shown, the shell portion 160 of the electronics device may include one or more connecting elements 162 configured to secure the attachment clip 100 to the shell portion 160. It should be readily appreciated that the connecting elements 162 can take numerous forms. For example, the attachment clip 100 may include one or more apertures that may be positioned to align with corresponding apertures on the shell portion 160, which may allow for a fastener (e.g., a threaded bolt) to secure the two components to one another.

Beyond being configured to ensure a secure connection of the attachment clip 100, the electronics device may be specifically configured to assist with the attachment functionality of the clip 100. For instance, the shell portion 160 may include one or more recesses configured to receive a gripping member of the attachment clip 100, such that the gripping member may more-securely enclose and/or secure an object. Likewise, the shell portion 160 may include one or more protrusions configured to contact a gripping member of the attachment clip 100. As previously described, the electronic device may take many forms, and may specifically be a wireless portable communication device.

FIGS. 2A-3F depict various views of an attachment clip 200 having a rotating locking member 230. Generally, the attachment clip 200 includes a body member 210 that is configured to pivot on an axis 202 between a closed position (as depicted in FIGS. 2A-2F)) and an open position, a torsion spring 204 coupled to the body member 210 and configured to apply a torque to rotate the body member 210 toward the closed position, and a connecting member 220 coupled to the torsion spring 204 and configured to secure the attachment clip 200 to an electronics device. As will be further described, the locking member 230 may be coupled to the body member 210 and configured move from an unlocked position to a locked position. When in the locked position, the body member 210 may be prevented from pivoting to the open position. In other words, the locking member 230 may function to keep the body member 210 in a closed position when a secure connection is desired by a user.

The body member 210 may have an extended length and a width that is parallel to the axis 202, as shown. The locking member 230 may generally be positioned on one end of the body member 210, while a gripping member 212 formed of two protrusions may be positioned at the other end. The gripping member 212 may function to help ensure a secure connection between the attachment clip 200 and any object which is clamped in the space between the body member 210 and the connecting member 220. Various gripping members 212 are depicted throughout the present disclosure, and it should be appreciated that any of these members may be used with any of the attachment clips described herein. For example, the gripping members 212 may include one or more protrusions, hooks, textured surfaces, or similar components capable of securing an object, such as a fabric. As shown, the body member 210 may have a top surface positioned away from the connecting member 220. The top surface may include one or more protrusions or surface textures which may permit a user to easily contact and apply a force to the attachment clip 200. Such surface modifications may be specifically positioned on the section of the body member 210 near the end that is opposite the gripping members (i.e., the distal end), such that a user may easily press down on said end and thereby rotate the body member 210 from a closed position to an open position.

In this depiction, the locking member 230 is shown in the form of a rotatable tab configured to rotate around a locking member axis 234 at the proximal end of the body member 210. In this manner the locking member 230 may rotate from a locked position (i.e., where the locking member 230 is substantially perpendicular to the body member 210) to an unlocked position (i.e., where the locking member 230 is no longer substantially perpendicular to the body member 210). When in a locked position, the locking member 210 may be configured to specifically contact the electronics device and thereby prevent rotation of the body member 210 from a closed position to an open position. Accordingly, the locking member 230 may have a length that substantially matches the distance from the locking member axis 234 to the electronics device. The locking member 230 may include an internal torsion spring 236. The internal torsion spring 236 may be configured to apply a torque to rotate the locking member 230 toward the locked position, such that the locking member 230 naturally returns to the locked position (i.e., substantially perpendicular to the body member 210) when a user is not applying a force to the locking member 230. This arrangement may ensure that the default state of the attachment clip 200 is a locked state. Additionally, a contact portion 232 of the locking member 230 may be configured to extend above the top surface of the body member 210. This arrangement may permit a user to simultaneously unlock and open the attachment clip 200 with a single motion. For instance, by pressing downward on both the contact portion 232 and the proximal end of the body member 210, the locking member 230 may rotate to an unlocked position at the same time that the distal end of the body member 210 is raised. Advantageously, this single point of contact approach may permit a user to quickly open the attachment clip 200 with minimal effort and using only a single hand.

While a rotating locking member is depicted in FIGS. 2A-3F, it should be readily appreciated that alternative arrangements may be used to prevent the rotation of the body member 210 and thereby lock the attachment clip 200. For instance, a sliding tab, as opposed to a rotating tab, may be configured to be locked in place and may be utilized. Furthermore, rather than being positioned on the body member 232, the locking member 230 may instead be positioned on the electronics device itself, or on the connecting member 220 or a comparable element.

The torsion spring 204 may generally function to apply a constant rotational force to the body member 210, such that a clamping force is always exerted by the body member 210, even when in a closed position. With the torsion spring 204 applying a clamping force in all positions, the attachment clip 200 need not always be returned to a locked position. For instance, the attachment clip 200 may function to secure an object without returning to a locked state, such as when the size of the object is too large for the body member 210 to return to a fully closed position. In such instances, the attachment clip 200 may still function in an unlocked state, providing a less-secure means of attachment. Given that certain applications (e.g., emergency responder equipment) may have specific safety requirements, the torsion spring 204 may be configured such that the attachment clip 200 may provide at least a minimum clamping force. For example, the attachment clip 200 may be configured to provide a clamping force of at least at least 1 pound, at least 10 pounds, at least 50 pounds, or at least 100 pounds. In particular, the attachment clip 200 and any associated electronics device may be configured to satisfy the standards outlined in U.S. National Fire Protection Association (NFPA) 1981, Section 8.10.4. The force requirements may vary depending on the application, and the size, shape, and the spring constant of the torsion spring 204 may also vary accordingly. In order to ensure that the attachment clip 200 and any associated electronics device maintains its orientation when clipped to a user, the body member 210 may specifically have a sufficient width. For instance, the body member 210 may specifically have an average length to average width ratio of less than 4:1, less than 3:1, or less than 2:1 (i.e., the average length is less than twice the length of the average width). Maintaining a large width may help to prevent the attachment clip 200 from rotating when secured to an object, such as an article of clothing. This feature may be particularly useful for portable communication devices used by emergency responders, allowing the devices to remain in the original position in which they were secured, and thereby allowing a user to easily operate the device in low visibility conditions through muscle memory.

As previously described, the connecting member 220 may be used to connect the attachment clip 200 to an electronics device. The body member 210 may rotate relative to the connecting member 220 and the associated electronics device. As shown, the connecting member 220 may include a plurality of apertures 222A, 222B, 222C, 222D which may assist in forming the connection, such as by receiving one or more fasteners. Although not shown in this aspect, the connecting member 220 may include one or more additional gripping members, which may be configured to complement or interact with gripping members 212.

Figure 3A:
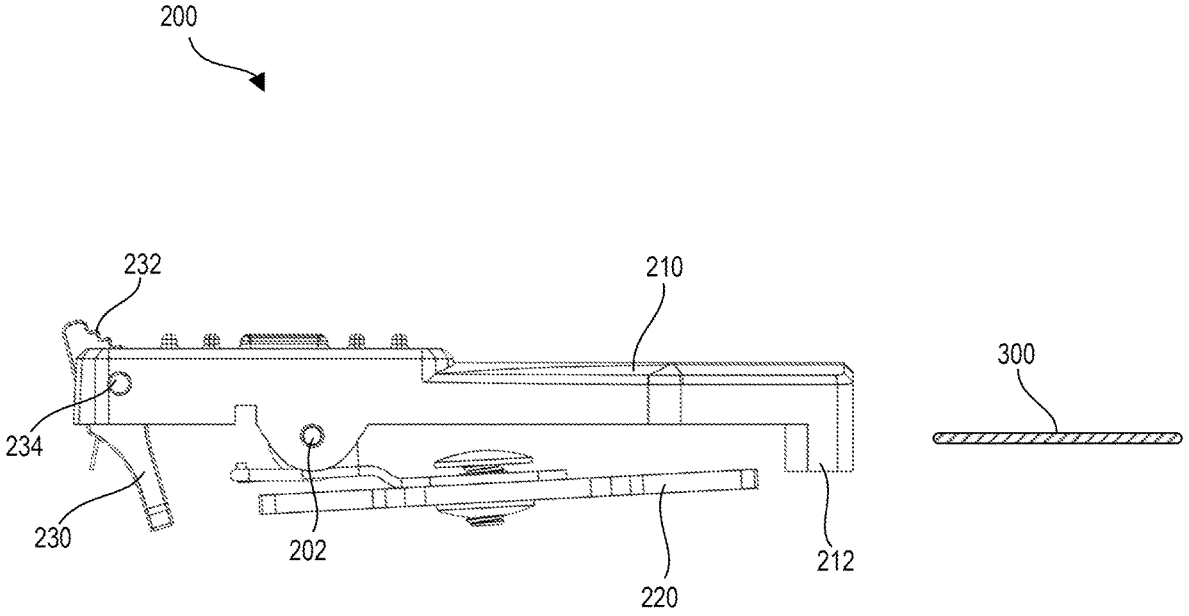
Figure 3B:
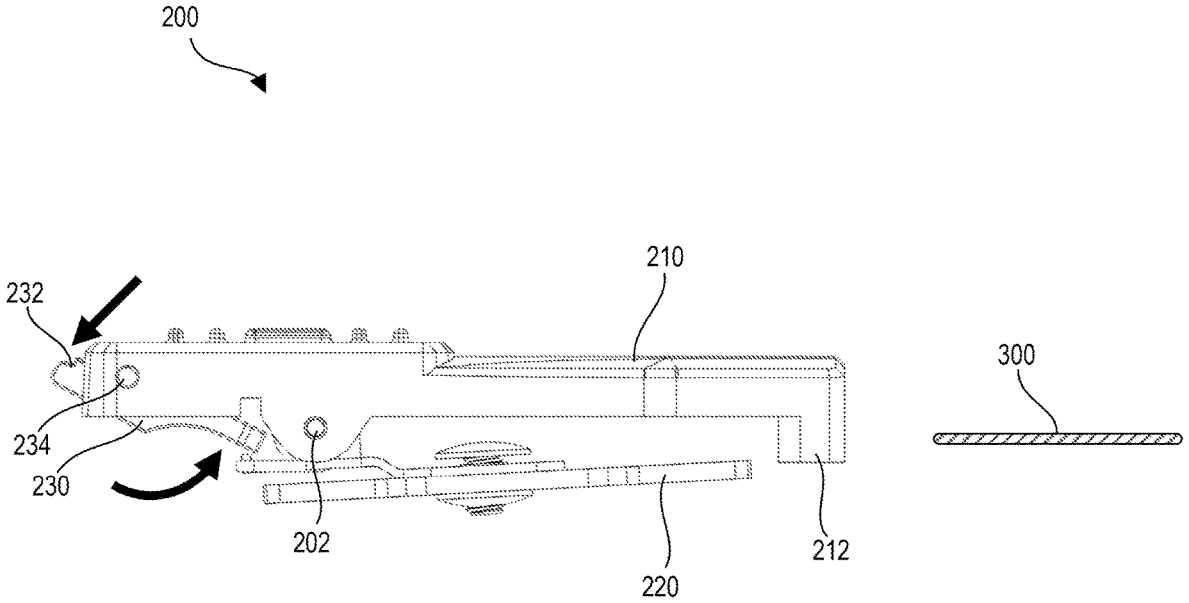
FIG. 3B is a diagram depicting a side view of the attachment clip of FIG. 3A in a closed position with a locking member having been rotated to an unlocked position.
Figure 3C:
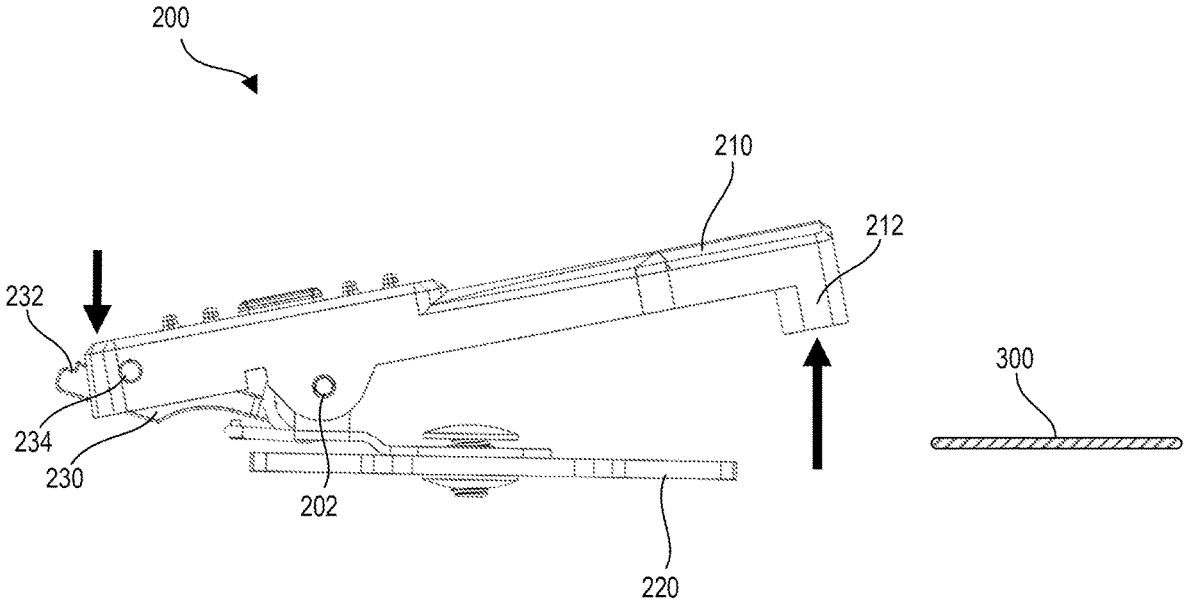
FIG. 3C is a diagram depicting a side view of the attachment clip of FIGS. 3A-3B with the locking member in an unlocked position and the attachment clip having pivoted to an open position.
Figure 3D:
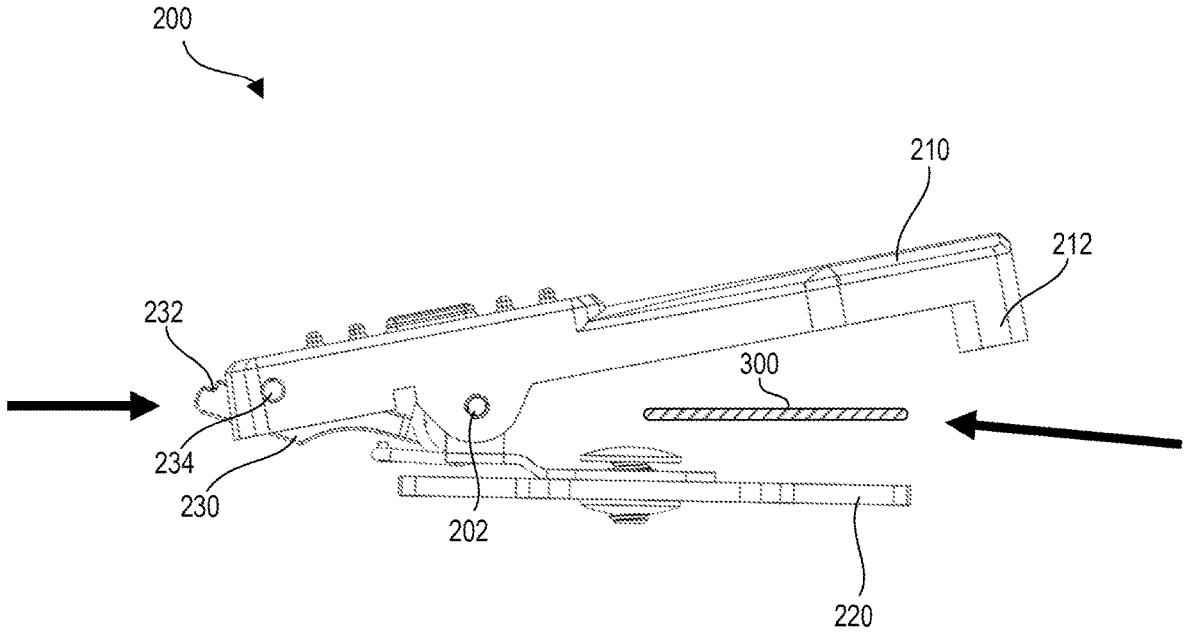
FIG. 3D is a diagram depicting a side view of the attachment clip of FIGS. 3A-3C with the attachment clip in an open position and the object having been positioned to be secured by the attachment clip.
Figure 3E:
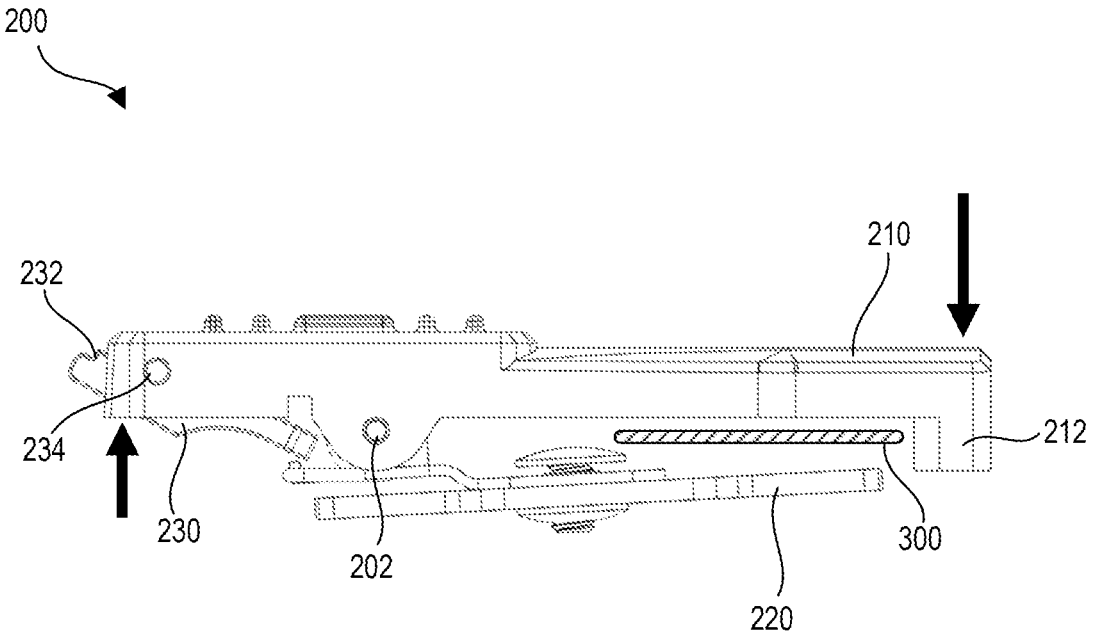
FIG. 3E is a diagram depicting a side view of the attachment clip of FIGS. 3A-3D with the attachment clip having pivoted to a closed position with the object now partially enclosed by the attachment clip.
Figure 3F:
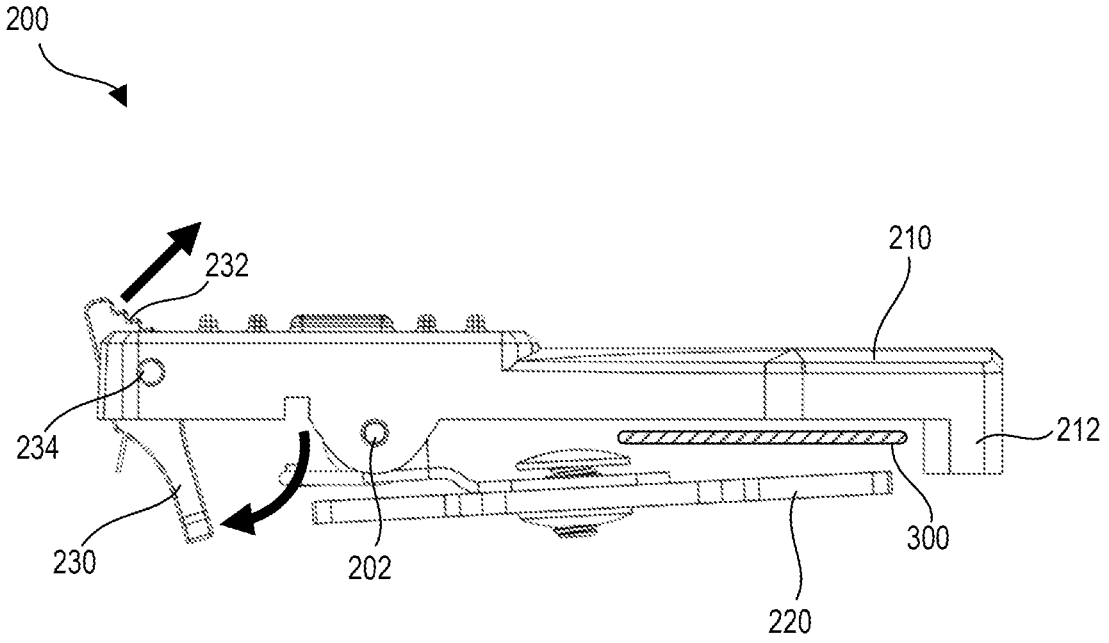
FIG. 3F is a diagram depicting a side view of the attachment clip of FIGS. 3A-3E in the closed position with the locking member having been rotated to a locked position.
Figure 4A:
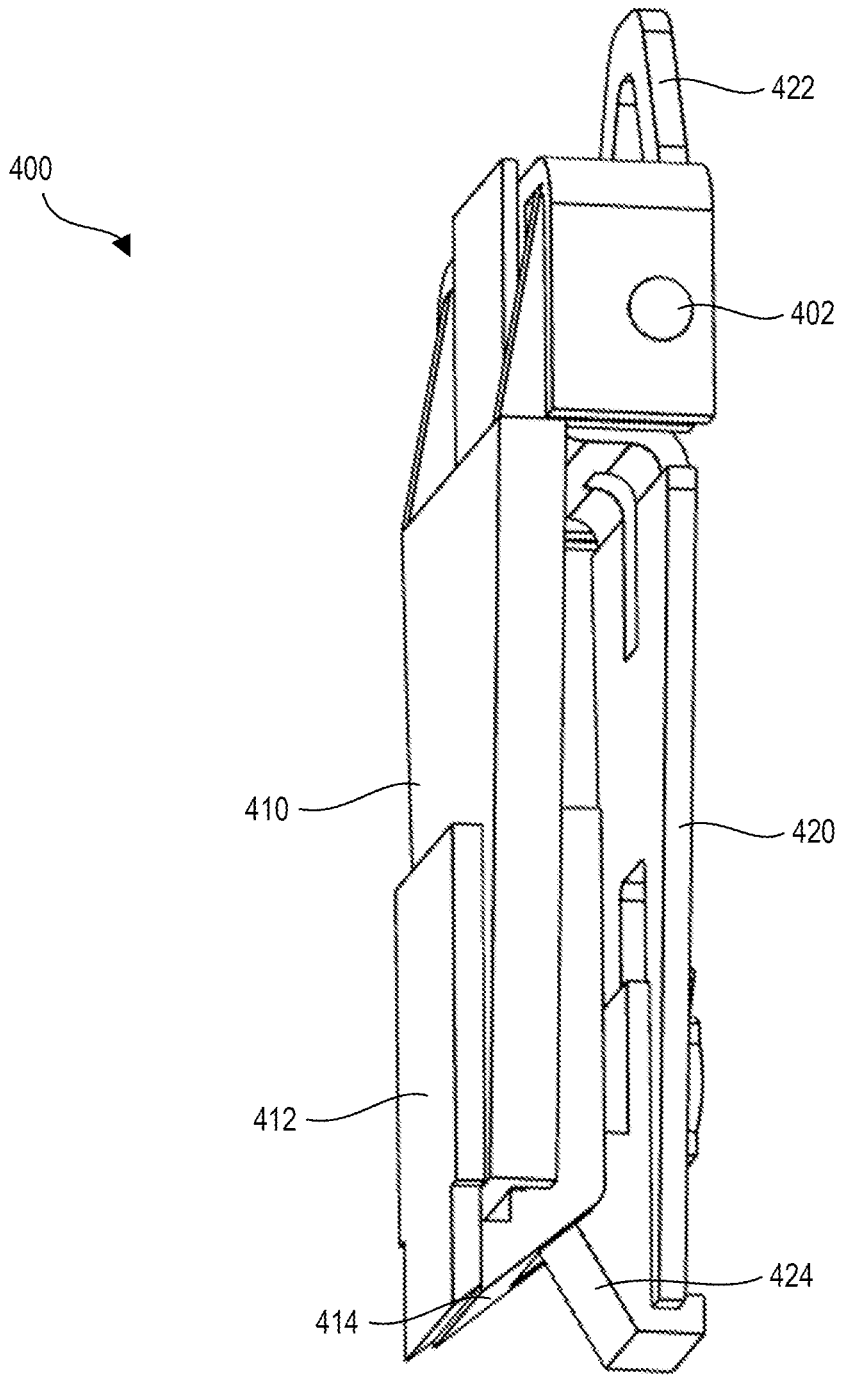
FIG. 4A is a diagram depicting a front, perspective view of an attachment clip having a sliding locking member.
Figure 4B:
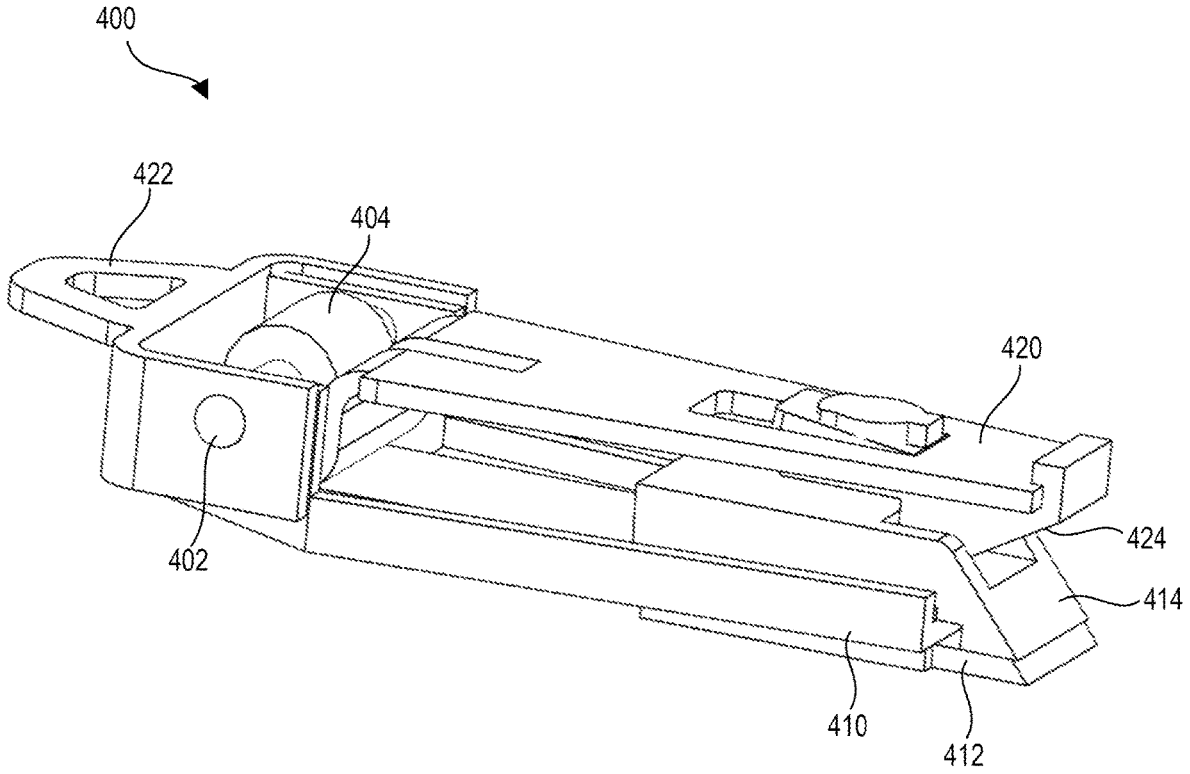
FIG. 4B is a diagram depicting a rear, perspective view of the attachment clip of FIG. 4A.
Figure 4C:
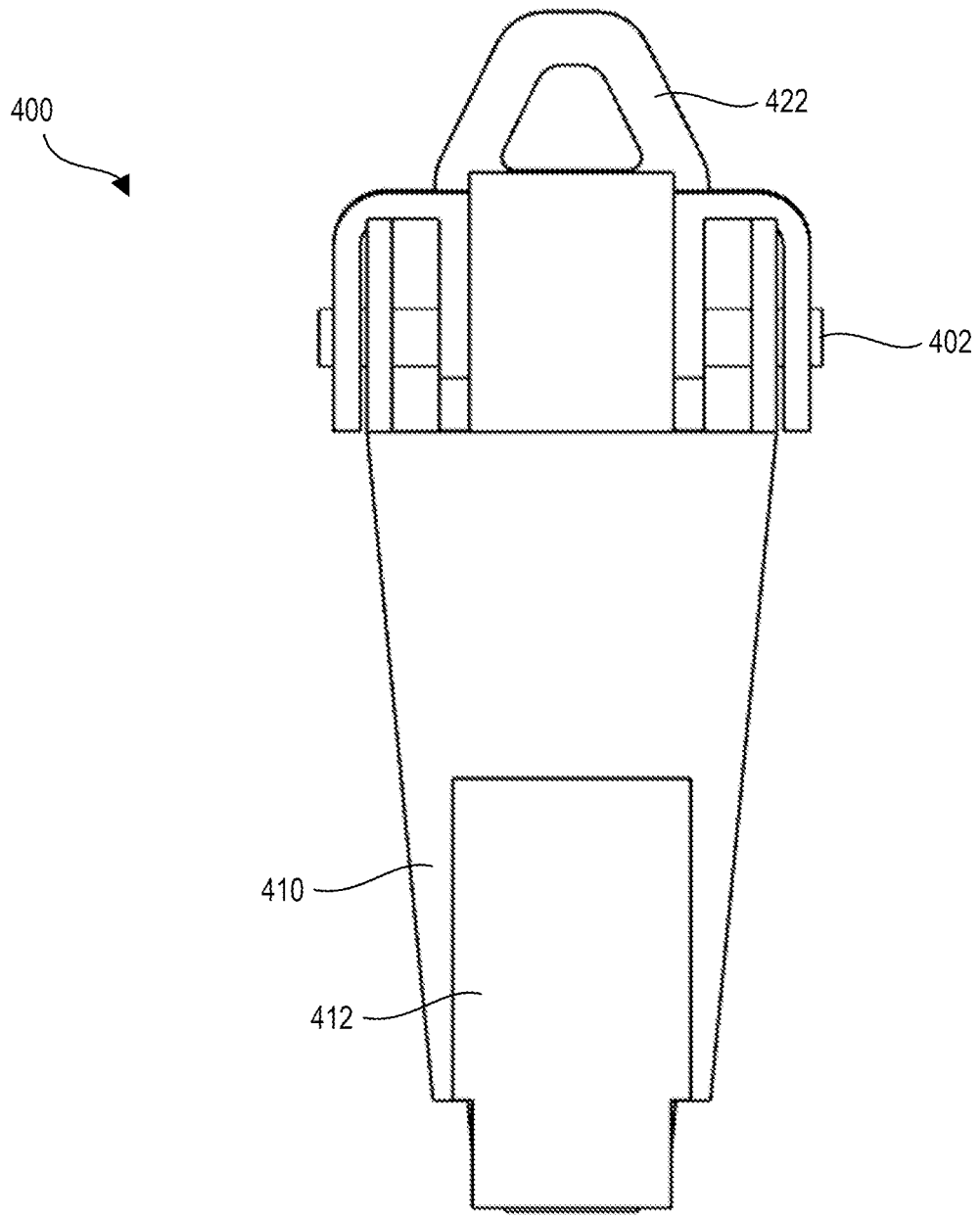
FIG. 4C is a diagram depicting a front view of the attachment clip of FIGS. 4A-4B.
Figure 4D:
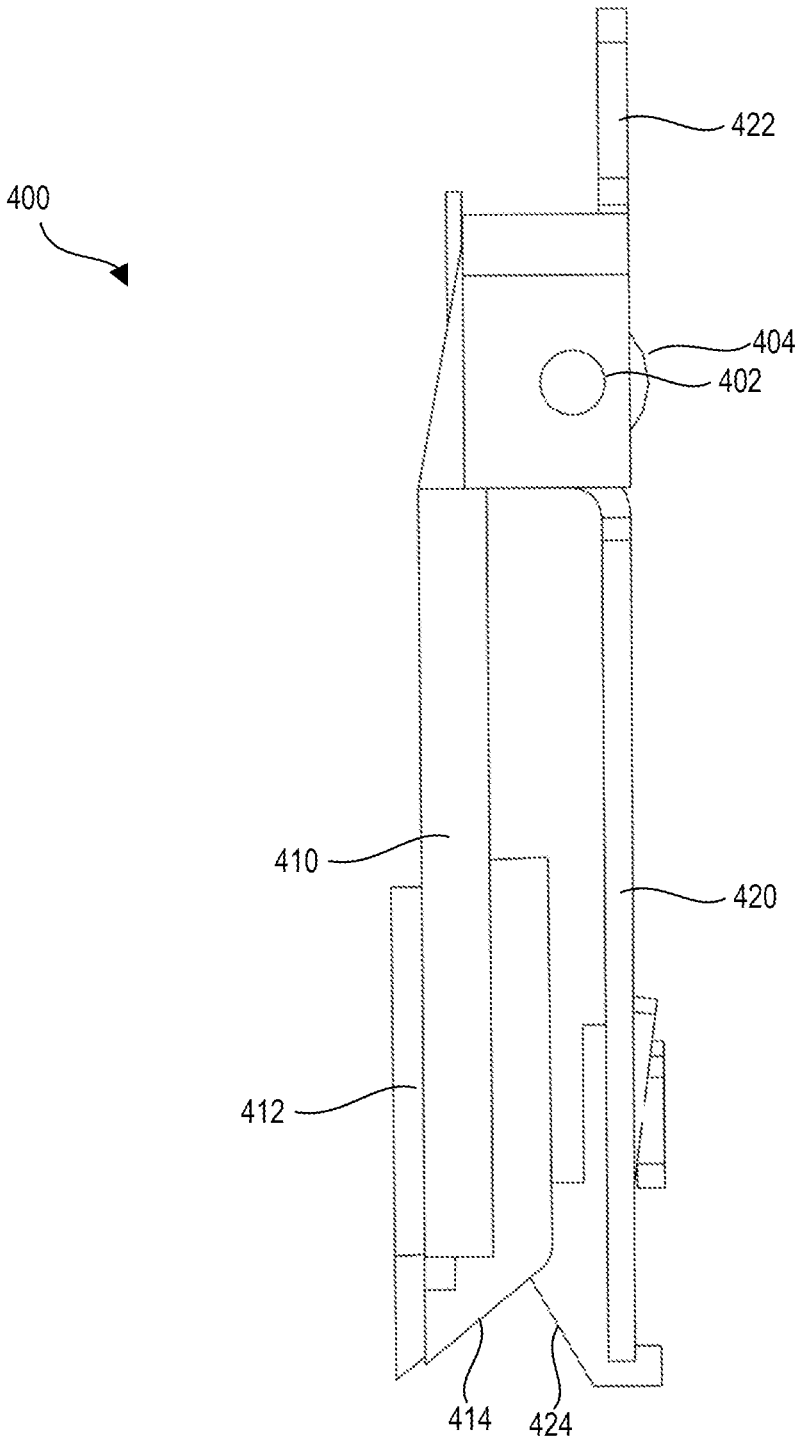
FIG. 4D is a diagram depicting a side view of the attachment clip of FIGS. 4A-4C.
Figure 4E:
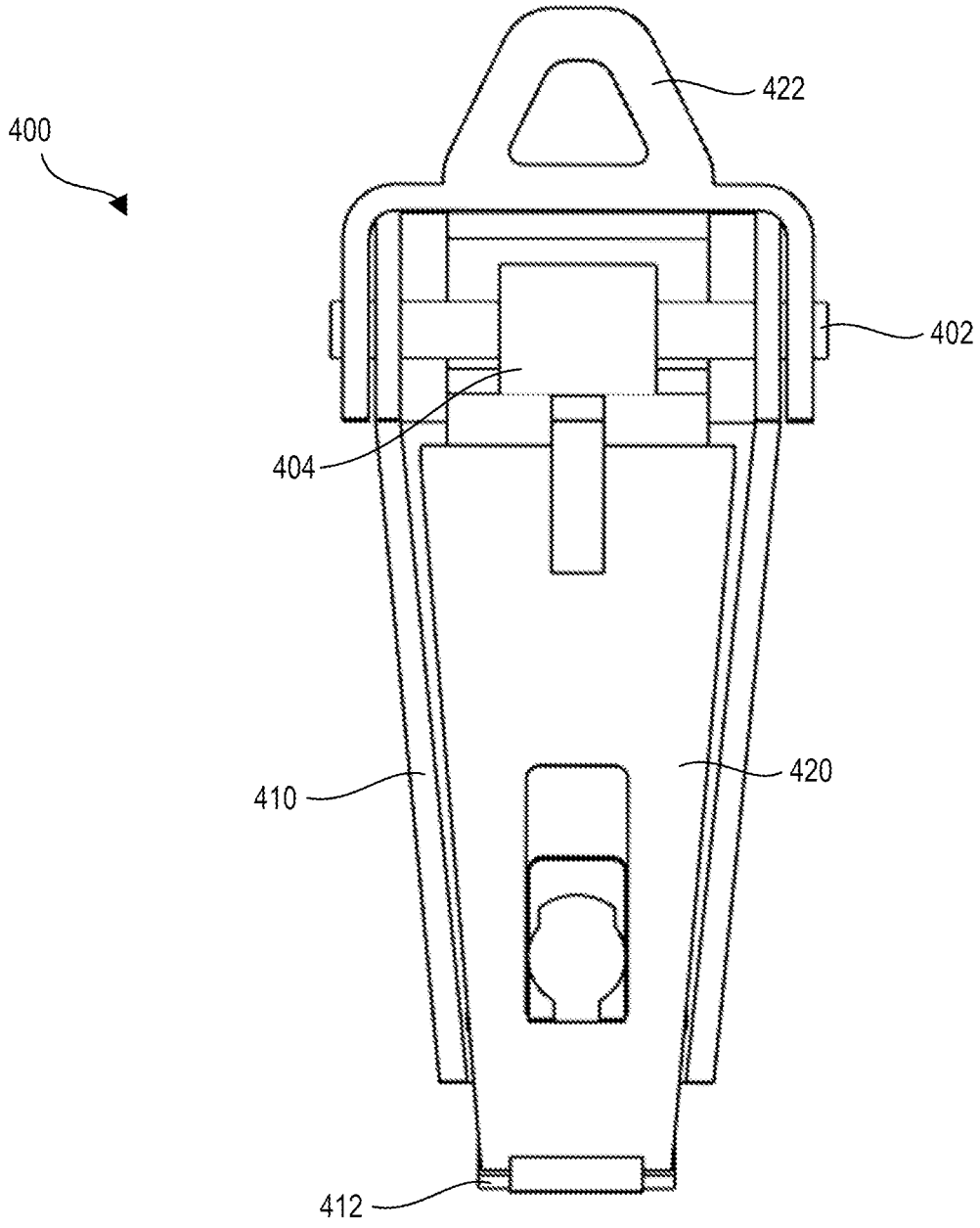
FIG. 4E is a diagram depicting a rear view of the attachment clip of FIGS. 4A-4D.
Figure 4F:
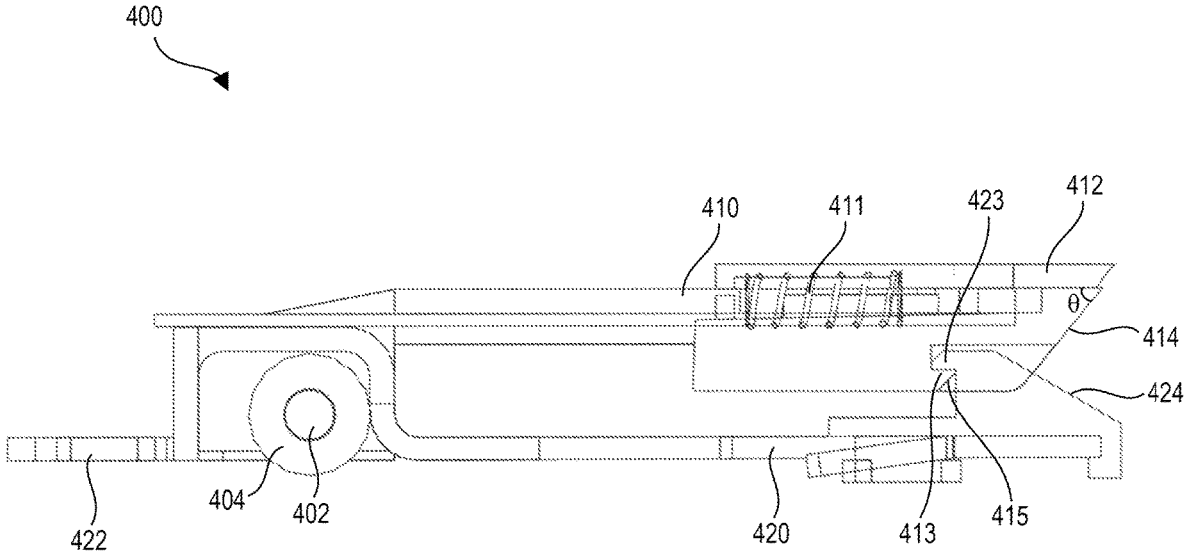
FIG. 4F is a diagram depicting a side, sectional view of attachment clip of FIGS. 4A-4E.

FIGS. 3A-3F depict a typical process of securing the attachment clip 200 to an object 300 (e.g., an equipment strap, a belt, a fabric of a jacket, etc.). In FIG. 3A, the attachment clip 200 is in a closed position and the locking member 230 is in a locked position. Next, in FIG. 3B the locking member 230 is rotated along the locking member axis 234 to an unlocked position, which may occur when a user applies a force to the contact portion 232. In FIG. 3C, now that the locking member 230 is in an unlocked state (i.e., deactivated), the body member 210 may then be pivoted to an open position, which may occur by a user pressing down on its proximal end. Given that the locking member 230 and the attachment clip 200 may be designed to both and unlock and open based on a single point of contact, this arrangement may permit the user to easily unlock the attachment clip 200 using a single hand. At this point, the object 300 to which the attachment clip 200 is intended to be connected to may be inserted at the distal end of the body member 210, as shown in FIG. 3D. Next, in FIG. 3E, the attachment clip 200 may return to a closed position, which may occur as a result of the force applied by the torsion spring 204, with the user releasing any applied pressure to the proximal end of the body member 210. Finally, in FIG. 3F, the locking member 230 may be returned to a locked state, which may occur as a result of the force applied by the internal torsion spring 236 and the user releasing any applied pressure to the contact portion 232 of the locking member 230. The object 300 has thereby been secured by the locked attachment clip 200.

FIGS. 4A-5E depict various views of an attachment clip 400 having a sliding locking member 412. Generally, and similar to and sharing many of the properties of the attachment clip 200 of FIGS. 2A-3F, the attachment clip 400 includes a body member 410 that is configured to pivot on an axis 402 between a closed position and an open position, a torsion spring 404 coupled to the body member 410 and configured to apply a torque to rotate the body member toward the closed position, and a connecting member 420 coupled to the torsion spring 404 and configured to secure the attachment clip 400 to an electronics device. The attachment clip 422 also includes a connection point 422, providing an additional contact point for a user. As will be further described, the locking member 412 may be coupled to the distal end of the body member 410 and configured move from an unlocked position to a locked position and vice versa. When in the locked position, the body member 410 may be prevented from pivoting to the open position. In other words, the locking member 412 may function to keep the body member 410 in a closed position when a secure connection is desired by a user. Unlike the attachment clip 200 of FIGS. 2A-3F, the locking member 412 functions by contacting and latching to a component of the connecting member 420. In other words, while the attachment clip 200 of FIGS. 2A-3F is locked by preventing the proximal end from rotating downward, the attachment clip 400 of FIGS. 4A-5E is locked by preventing the distal end from rotating upward.

In this depiction, the locking member 412 is shown in the form of a slidable latch configured to slide toward and away from the axis 402 at the distal end of the body member 410. In this manner the locking member 412 may slide from locked position (i.e., where the locking member 412 is latched to a component of the connecting member 420) to an unlocked position (i.e., where the locking member 412 is no longer latched to the connecting member 420). Specifically, the connecting member 420 may include a protrusion having a bottom surface 423 configured to contact the locking member 412 when the locking member 412 is both in a locked position and the body member 410 attempts to pivot to the open position. Relatedly, the locking member 412 may include a locking protrusion with a top surface 413 configured to contact the bottom surface 423. In this manner, the top surface 413 of the protrusion of the locking member 412 may form a latch with the bottom surface 423 of the protrusion of the connecting member 420. These two surfaces 413, 423 may be parallel to and opposed to on another when the attachment clip 400 is in a locked state. The locking member 412 may be configured to move laterally such that the two surfaces 413, 423 are no longer opposed to one another, and the locking member 412 may therefore enter an unlocked state. The locking member 412 may include a compression spring 411 configured to apply a force to slide the locking member 412 toward the locked position (i.e. toward the distal end of the body member 410). This arrangement may ensure that the default state of the attachment clip 400 is a locked state.

Other arrangements for creating a latch may alternatively be utilized. Moreover, rather than being located on the distal end of the body member 410, the contact point to unlock the locking member 412 (i.e., to disengage the latch) may be positioned on the proximal end of the locking member 412. Such an arrangement may permit a user to both unlock and open the body member 410 by contacting only the proximal end of the locking member 412, similar to the functionality of the attachment clip 200 of FIGS. 2A-3F.

Additionally, the locking member 412 may include a receiving surface 414 configured to guide a contacted object between the body member 410 and the connecting member 420. In this manner, an object may be easily positioned within the clamping region of the attachment clip 400. For example, an object may contact the receiving surface 414, and the force of this contact may cause the locking member 412 to slide to an unlocked state. Moreover, the angle of the receiving surface 414 may force the body member 410 to pivot to an open position as the object is pressed against the receiving surface 414 and guided toward the now-accessible clamping region between the body member 410 and the connecting member 420. Likewise, the connecting member 420 may include a second receiving surface 424 at its distal end to further assist in guiding the contacted object. In this manner, an object may be easily slid into the clamping region of the attachment clip 412. Furthermore, the receiving surface 414 may similarly function as a gripping surface for a user. For instance, a user may contact (e.g., with one or more fingers) the receiving surface 414 and simultaneously slide the locking member 412 into an unlocked state and pivot the body member 410 into an open state. Advantageously, this single point of contact approach may permit a user to quickly open the attachment clip 400 with minimal effort and using only a single hand. In order to achieve this functionality, the receiving surface 414 may have an angle (marked as θ in FIG. 4F) of less than 75 degrees, less than 60 degrees, or specifically less than 45 degrees relative to a top surface of the body member 410.

Figure 5A:
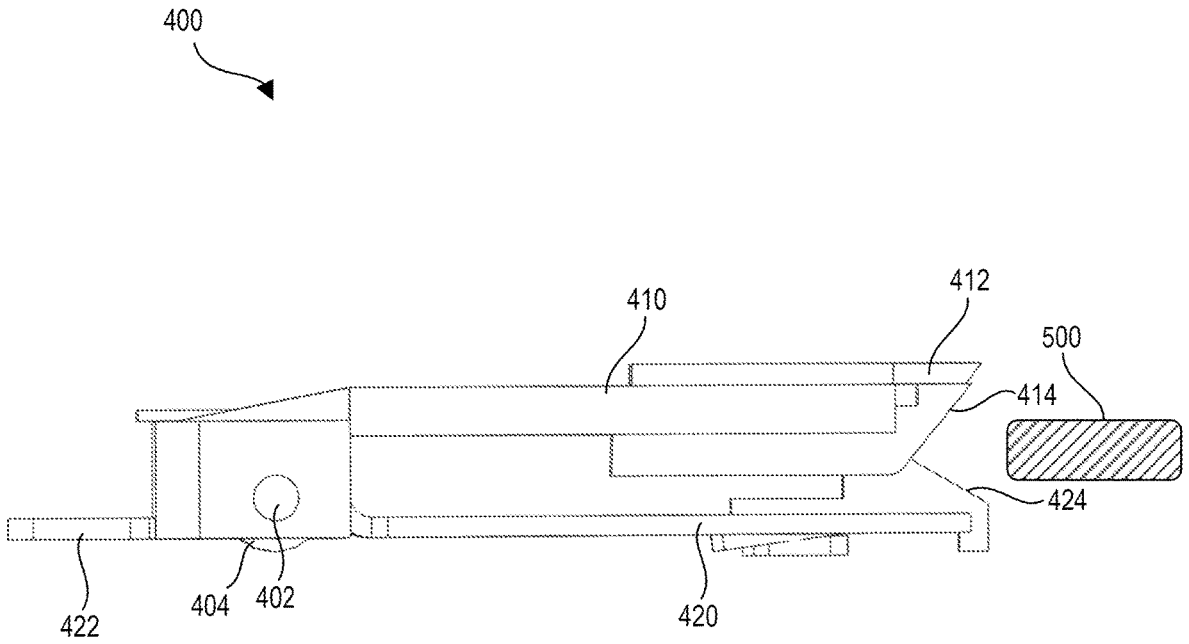
Figure 5B:
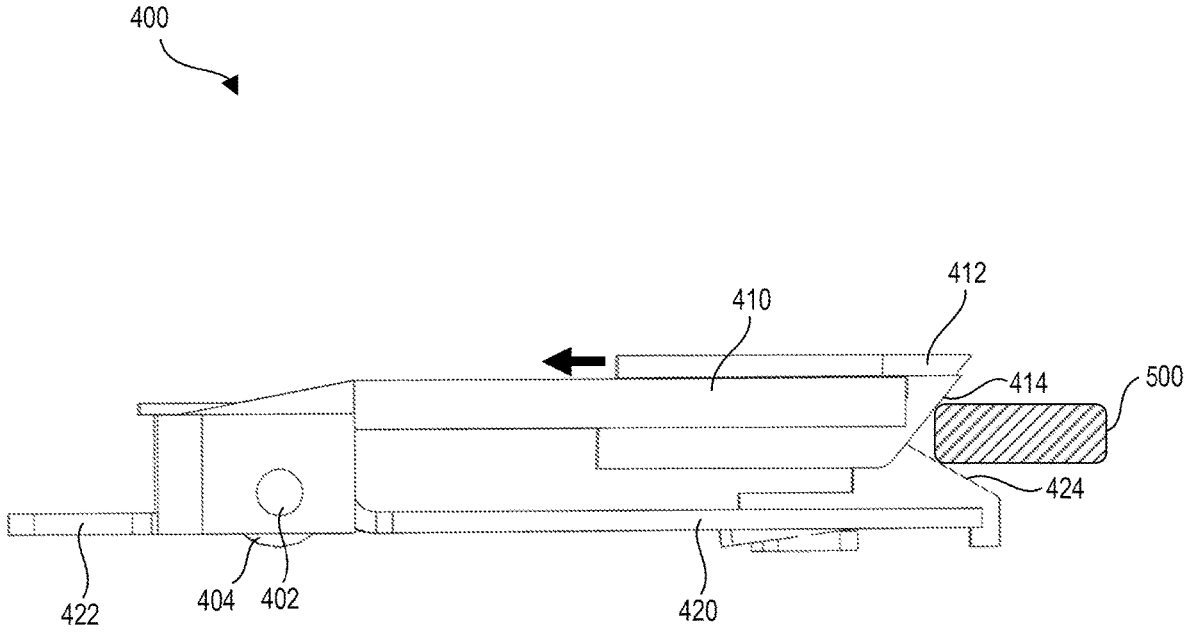
FIG. 5B is a diagram depicting a side view of the attachment clip of FIG. 5A in a closed position with a locking member having been slid to an unlocked position.
Figure 5C:
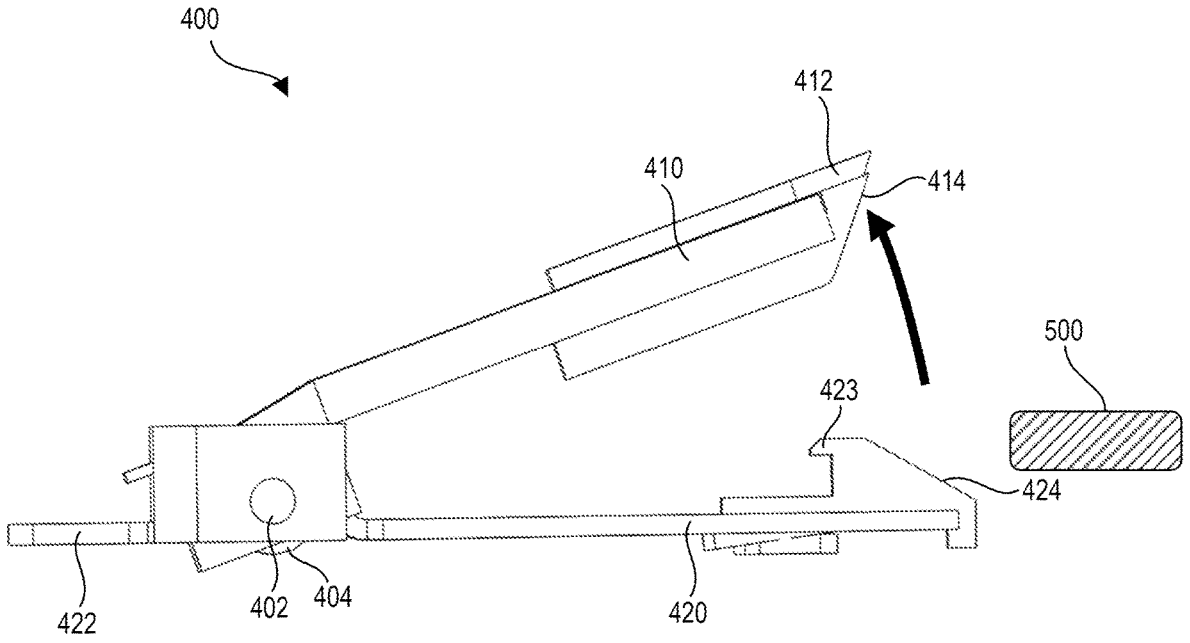
FIG. 5C is a diagram depicting a side view of the attachment clip of FIGS. 5A-5B with the attachment clip having pivoted to an open position.
Figure 5D:
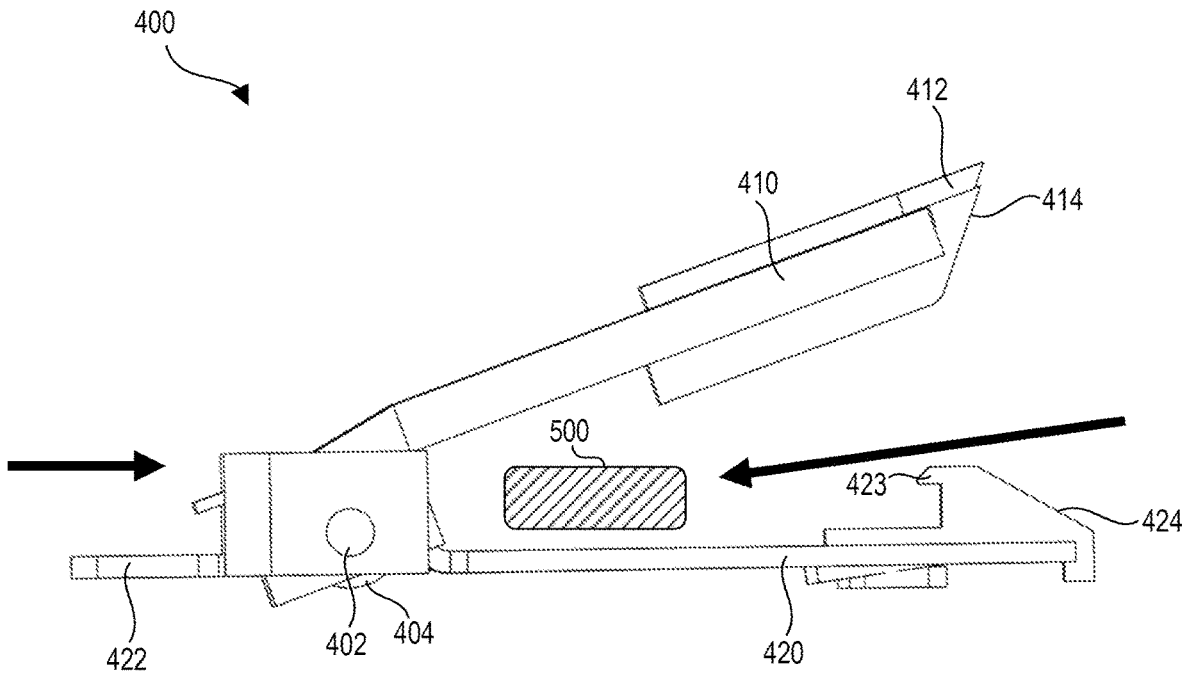
FIG. 5D is a diagram depicting a side view of the attachment clip of FIGS. 5A-5C with the attachment clip in an open position and the object having been positioned to be secured by the attachment clip.
Figure 5E:
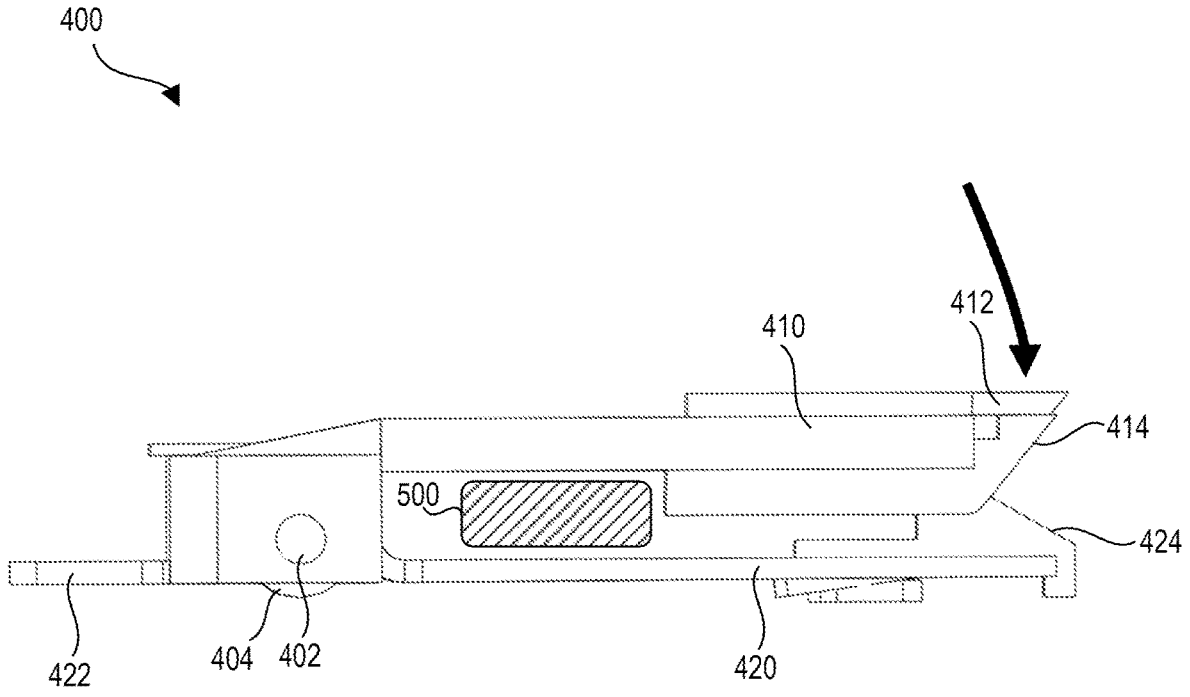
FIG. 5E is a diagram depicting a side view of the attachment clip of FIGS. 5A-5D with the attachment clip having pivoted to a closed position and the locking member having slid to a locked position, with the object now partially enclosed by the attachment clip.
Figure 6A:
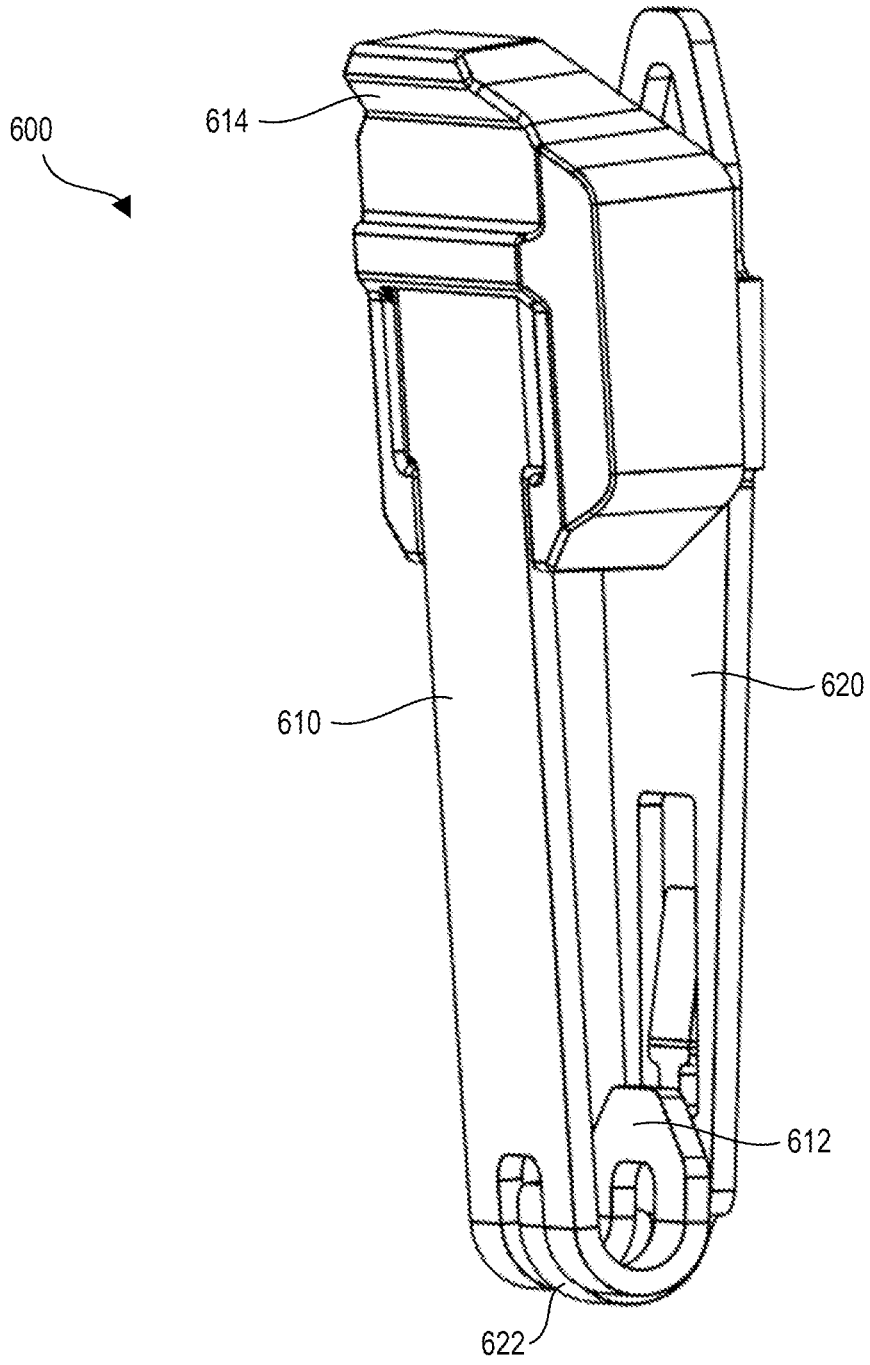
FIG. 6A is a diagram depicting a front, perspective view of an attachment clip having hooked protrusions at an attachment end.
Figure 6B:
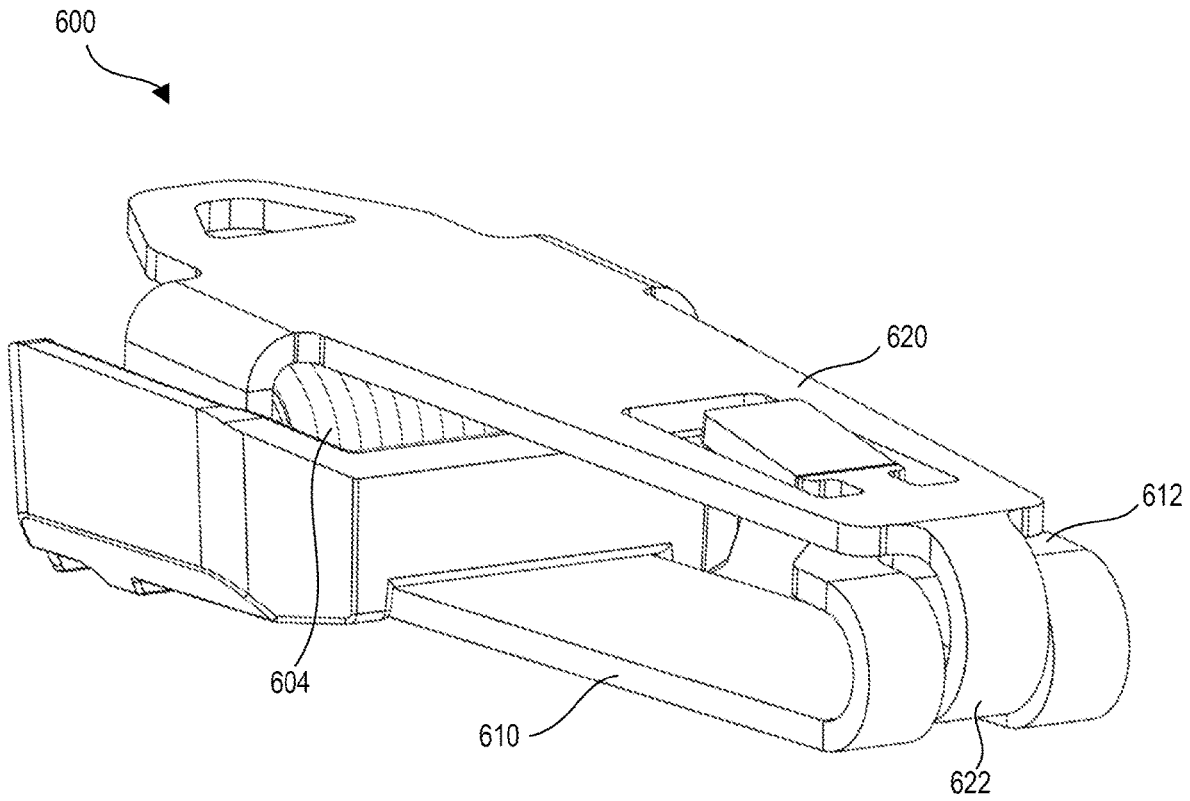
FIG. 6B is a diagram depicting a rear, perspective view of the attachment clip of FIG. 6A.
Figure 6C:
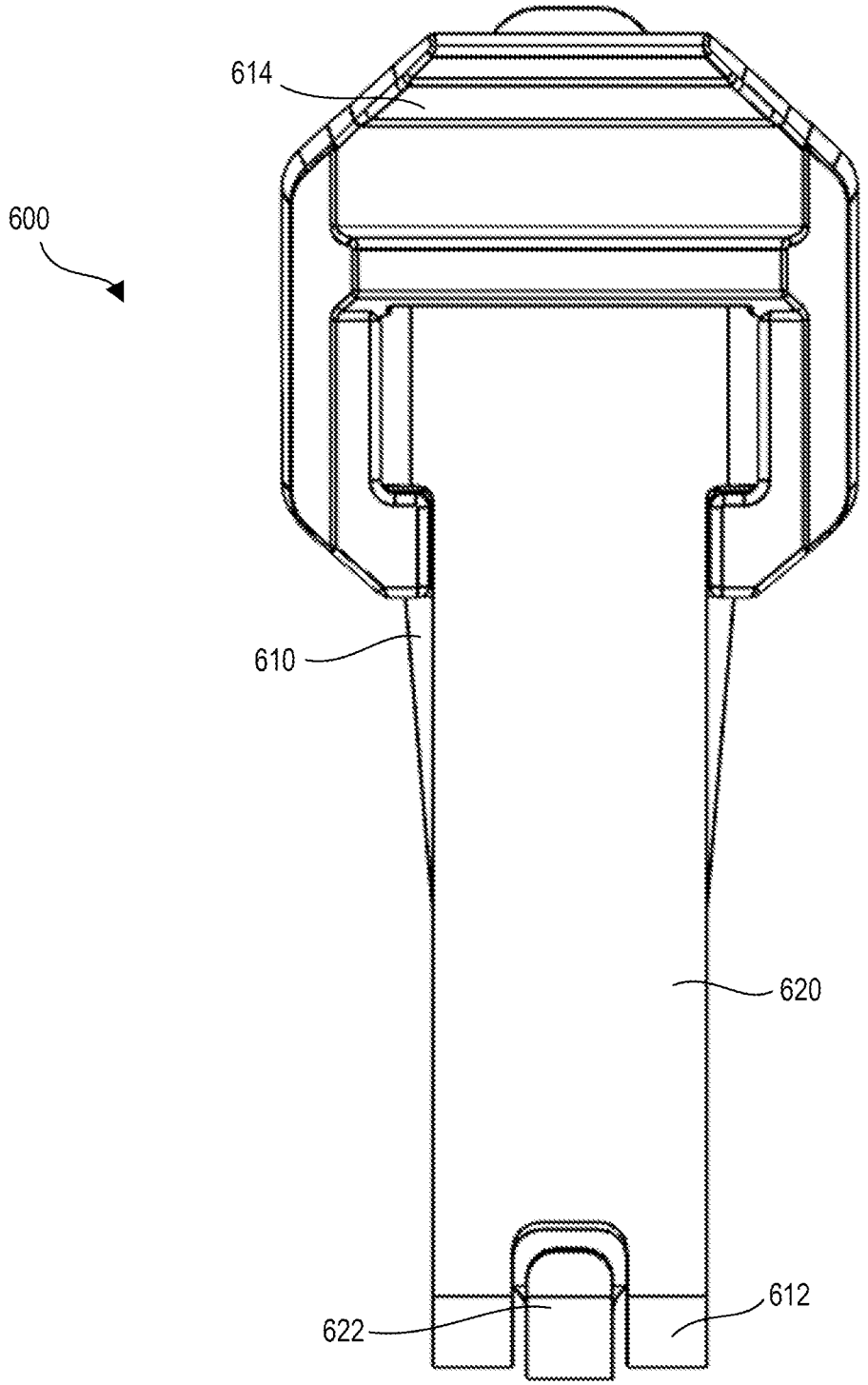
FIG. 6C is a diagram depicting a front view of the attachment clip of FIGS. 6A-6B.
Figure 6D:
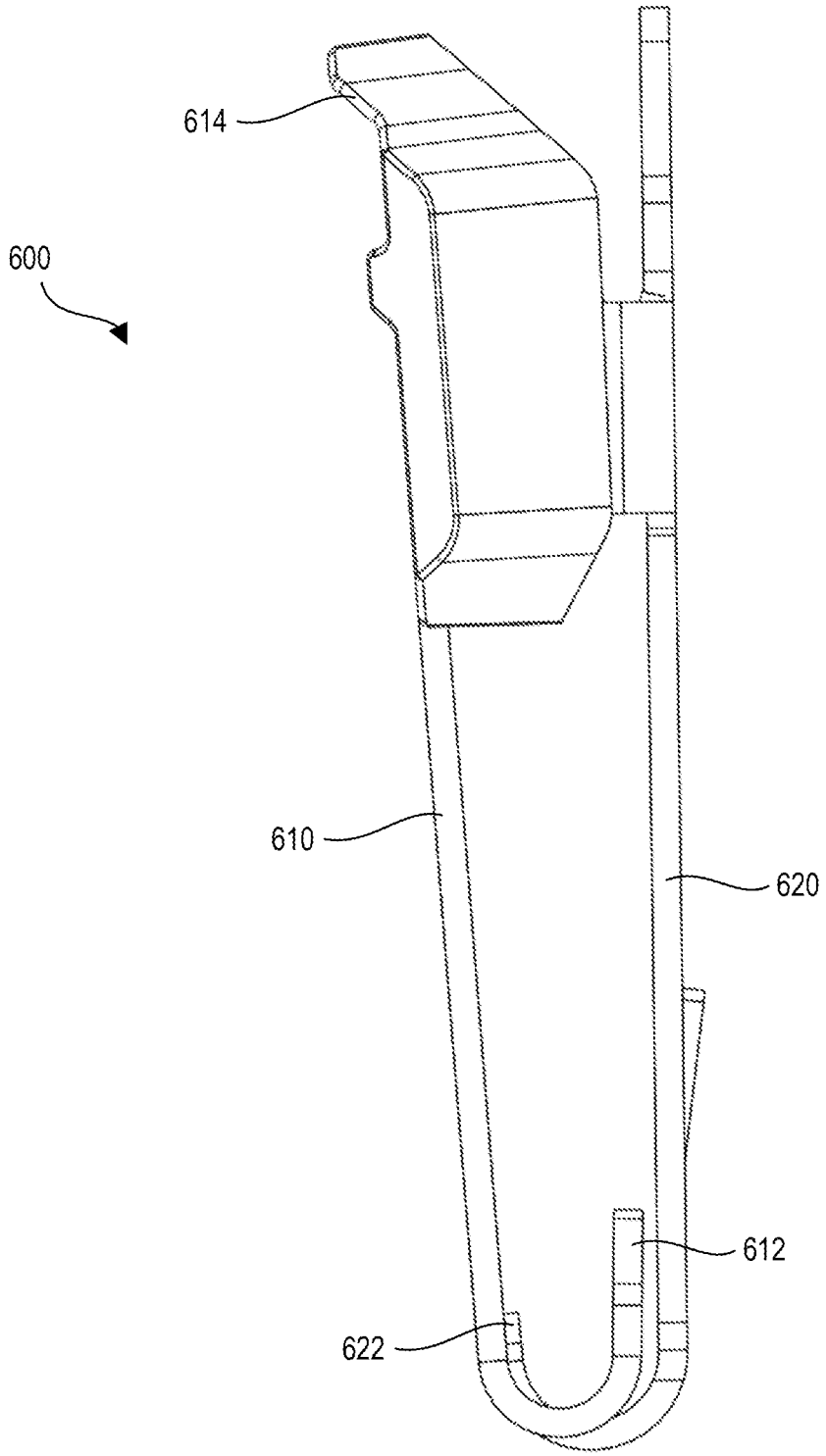
FIG. 6D is a diagram depicting a side view of the attachment clip of FIGS. 6A-6C.
Figure 6E:
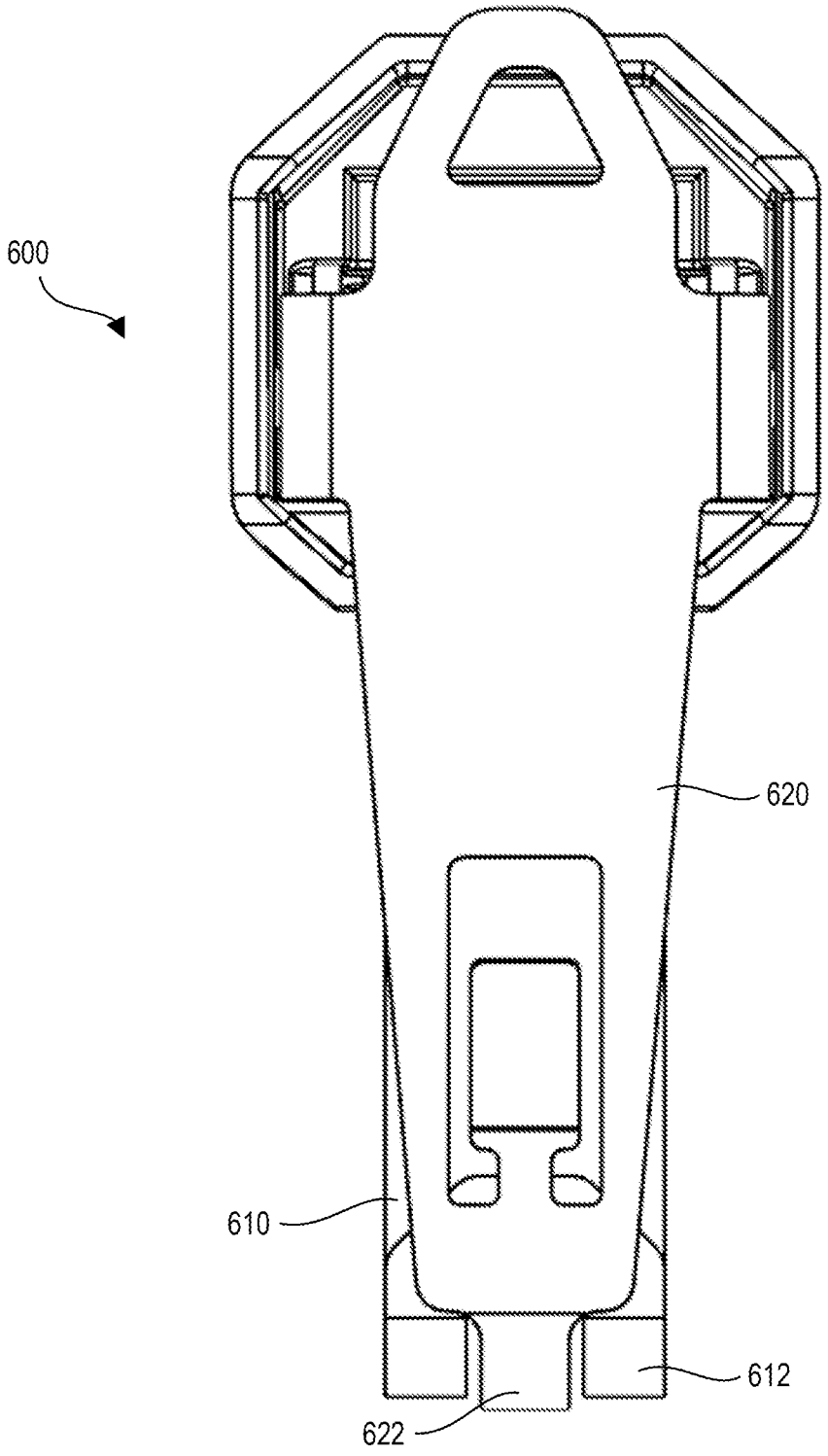
FIG. 6E is a diagram depicting a rear view of the attachment clip of FIGS. 6A-6D.

FIGS. 5A-5E depict a typical process of securing the attachment clip 400 to an object 500. In FIG. 5A, the attachment clip 400 is in a closed position the locking member 412 is in a locked position. Next, in FIG. 5B the locking member 412 has slid 234 to an unlocked position, which may occur as a result of the object 500 contacting the receiving surface 414 or from a user manually sliding the locking member 412. In FIG. 5C, now that the locking member 412 is in an unlocked state (i.e., deactivated), the body member 410 may then be pivoted to an open position, which may occur as a result of the object 500 being pressed against the angled receiving surface 414 or from a user pulling up on the distal end of the body member 410. At this point, the object 500 to which the attachment clip 400 is intended to be connected to may be inserted at the distal end of the attachment clip 400, as shown in FIG. 5D. Next, in FIG. 5E, the attachment clip 400 may return to a closed position, which may occur as a result of the force applied by the torsion spring 404 and the user releasing any pulling force on the body member 410. As the attachment clip 400 returns to a closed position, the locking member 430 may be returned to a locked state automatically, which may occur as a result of the force applied by the torsion spring 404 and an angled bottom section on the locking member 412, which may temporarily compress the compression spring 411 until the two surfaces 413, 423 may overlap and the compression spring 411 can again decompress, thereby re-latching the locking member 412. The object 500 has thereby been secured by the locked attachment clip 400. This fully-closed and locked position is maintained regardless of any forces applied that might otherwise counteract the spring force and open the attachment clip 400.

Similar to the attachment clip 200 of FIGS. 2A-3F, the attachment clip 400 may be used in less-secure locations (e.g., within a pocket, or on a coat lapel), where the clip clamping portion is not permitted to completely close and lock, but rather maintains a clamping force on a portion of material. With such situations, the locking member 412 of the attachment clip 400 may not fully latch, but the attachment clip 400 may still beneficially remain clamped and connected.

FIGS. 6A-7D depict various views of an attachment clip 600 having gripping members 612, 622 formed of hooked protrusions to help ensure that any attached objects remain secured within the attachment clip 600. Unlike the attachment clips depicted in FIGS. 2A-5E, the attachment clip 600 does not include a locking member, but instead relies on the geometric arrangement of the gripping member 612, 622 to prevent the attachment clip 600 from inadvertently opening. As shown, the attachment clip 600 may generally include a body member 610 having a first gripping member 612 and a connecting member 620 having a second gripping member 622. A contact tab 614 is coupled to the body member 610 and configured to provide a contact point for a user to apply a downward pressure to the proximal end of the body member 610 and thereby pivot the attachment clip to an open position.

The gripping members 612, 622 may include complementary, curved protrusions, which may interlock, as shown. The gripping members 612, 622 may generally function by contacting a secured object (e.g., equipment strap) positioned between the body member 610 and the connection member 620 and, through this contact, preventing the attachment clip 600 from pivoting to an open position. In order to achieve this functionality, one or more of the gripping members 612, 622 may have a protrusion that at least partially encloses a secured object on both its top side and its bottom side when positioned in the clamping region of the attachment clip 600. For instance, the gripping member 612, 622 may include hooked components having a curvature of at least 120 degrees, at least 150 degrees, or specifically about 180 degrees. It should be readily appreciated that the gripping members 612, 622 may be integrated with the attachment clips of FIGS. 2A-3F and FIGS. 4A-5E previously described herein.

Figure 7A:
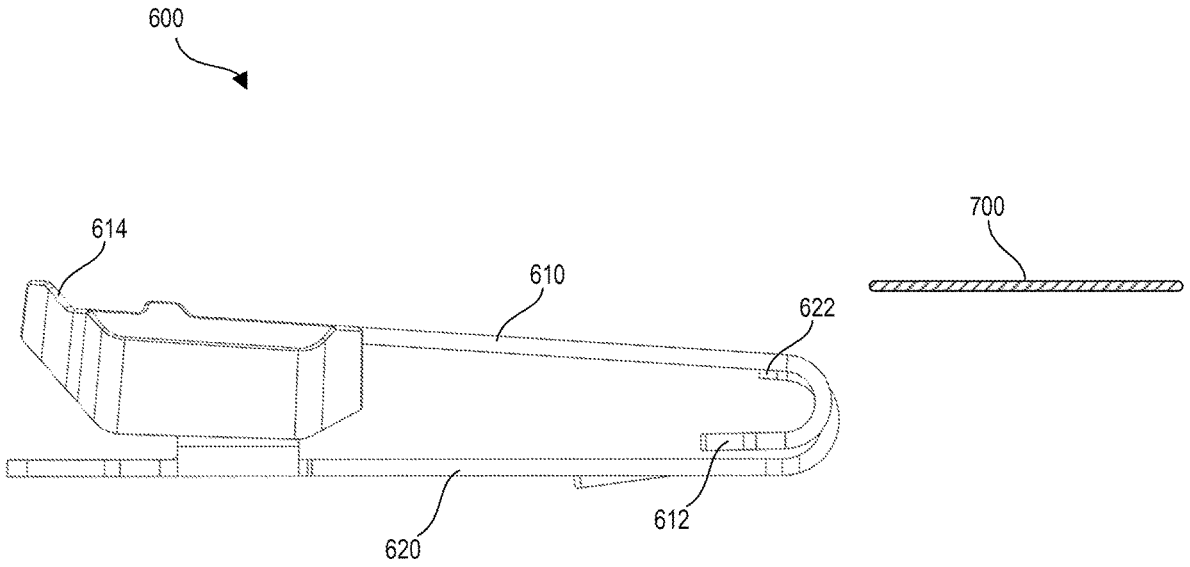
FIG. 7A is a diagram depicting a side view of the attachment clip of FIGS. 6A-6E in a closed position and an object for the attachment clip to be secured.
Figure 7B:
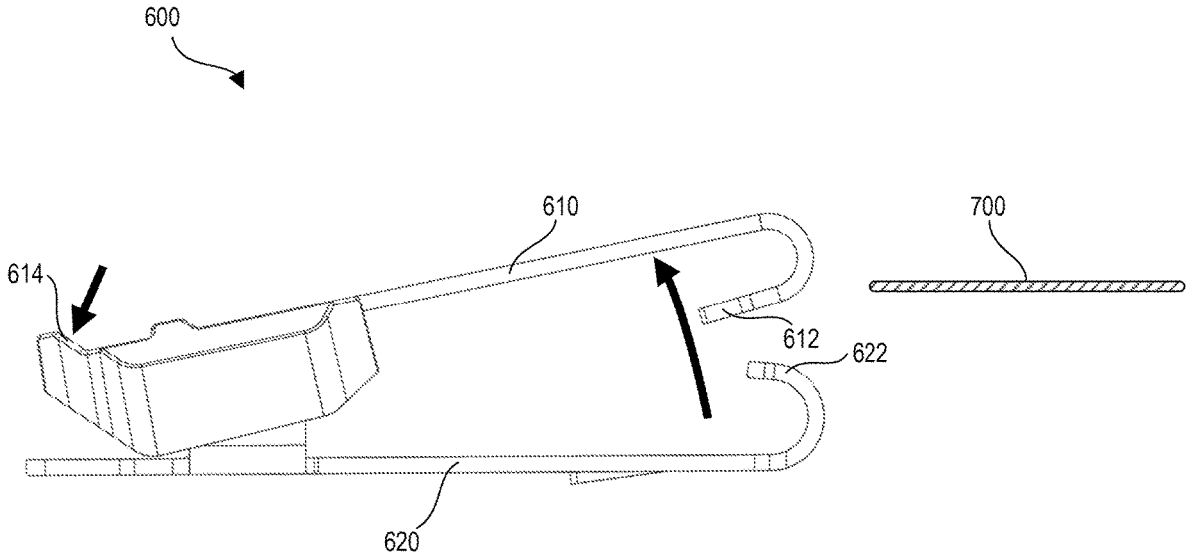
FIG. 7B is a diagram depicting a side view of the attachment clip of FIG. 7A with the attachment clip having pivoted to an open position.
Figure 7C:
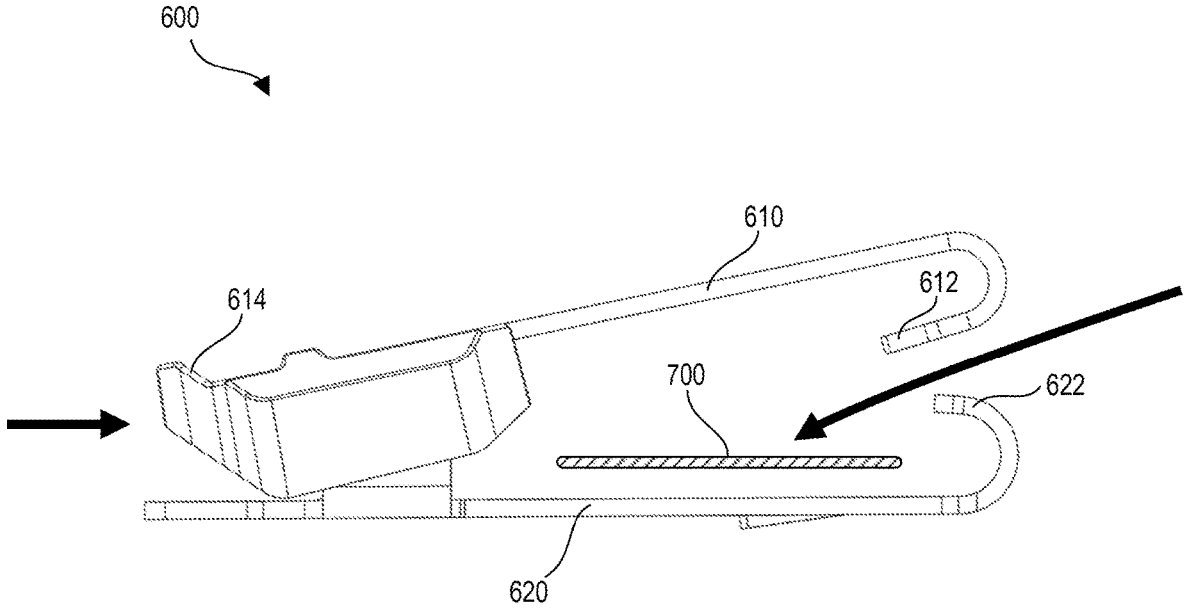
FIG. 7C is a diagram depicting a side view of the attachment clip of FIGS. 7A-7B with the attachment clip in an open position and the object having been positioned to be secured by the attachment clip.
Figure 7D:
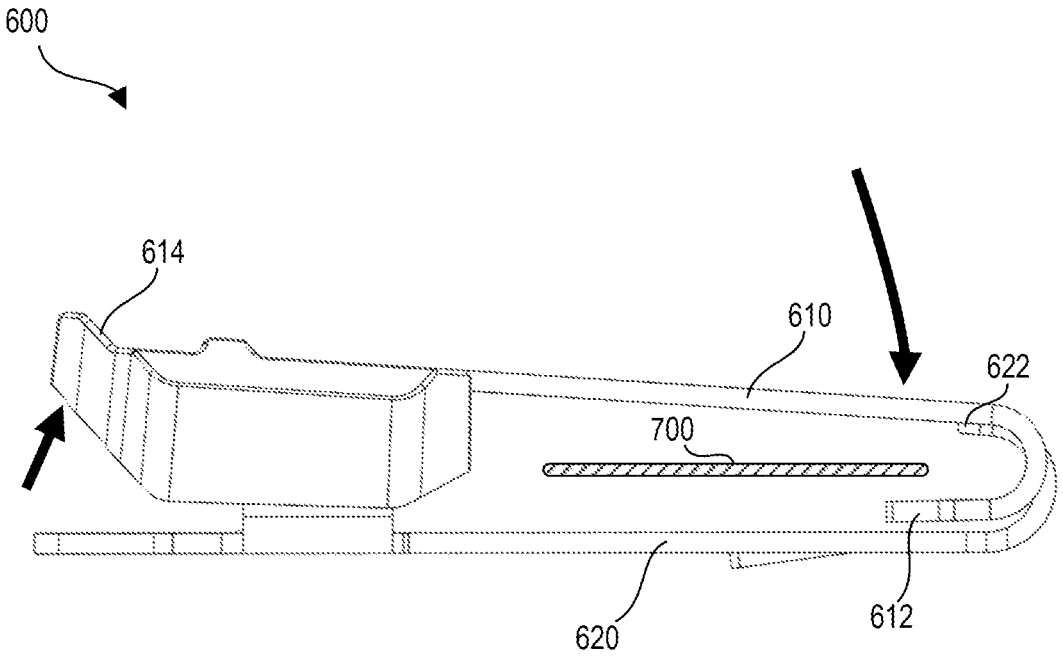
FIG. 7D is a diagram depicting a side view of the attachment clip of FIGS. 7A-7C with the attachment clip having pivoted to a closed position and the locking member having slid to a locked position, with the object now partially enclosed by the attachment clip.

FIGS. 7A-7D depict a typical process of securing the attachment clip 600 to an object 700. In FIG. 7A, the attachment clip 600 is in a closed position. Next, in FIG. 7B the body member 610 may then be pivoted to an open position, which may occur as a result of a user pressing down on the proximal end of the body member 610. At this point, the object 700 to which the attachment clip 600 is intended to be connected to may be inserted at the distal end of the body member 610, as shown in FIG. 7D. Finally, in FIG. 7D, the attachment clip 600 may return to a closed position, which may occur as a result of the force applied by the torsion spring (internal feature, not visible in this depiction), with the user releasing any force on the body member 610. The object 700 has thereby been secured by the locked attachment clip 600. Should the attachment clip 600 attempt to inadvertently open, the object 700 may catch on the gripping members 612, 622, thereby preventing the attachment clip 600 from opening.

Figure 8:
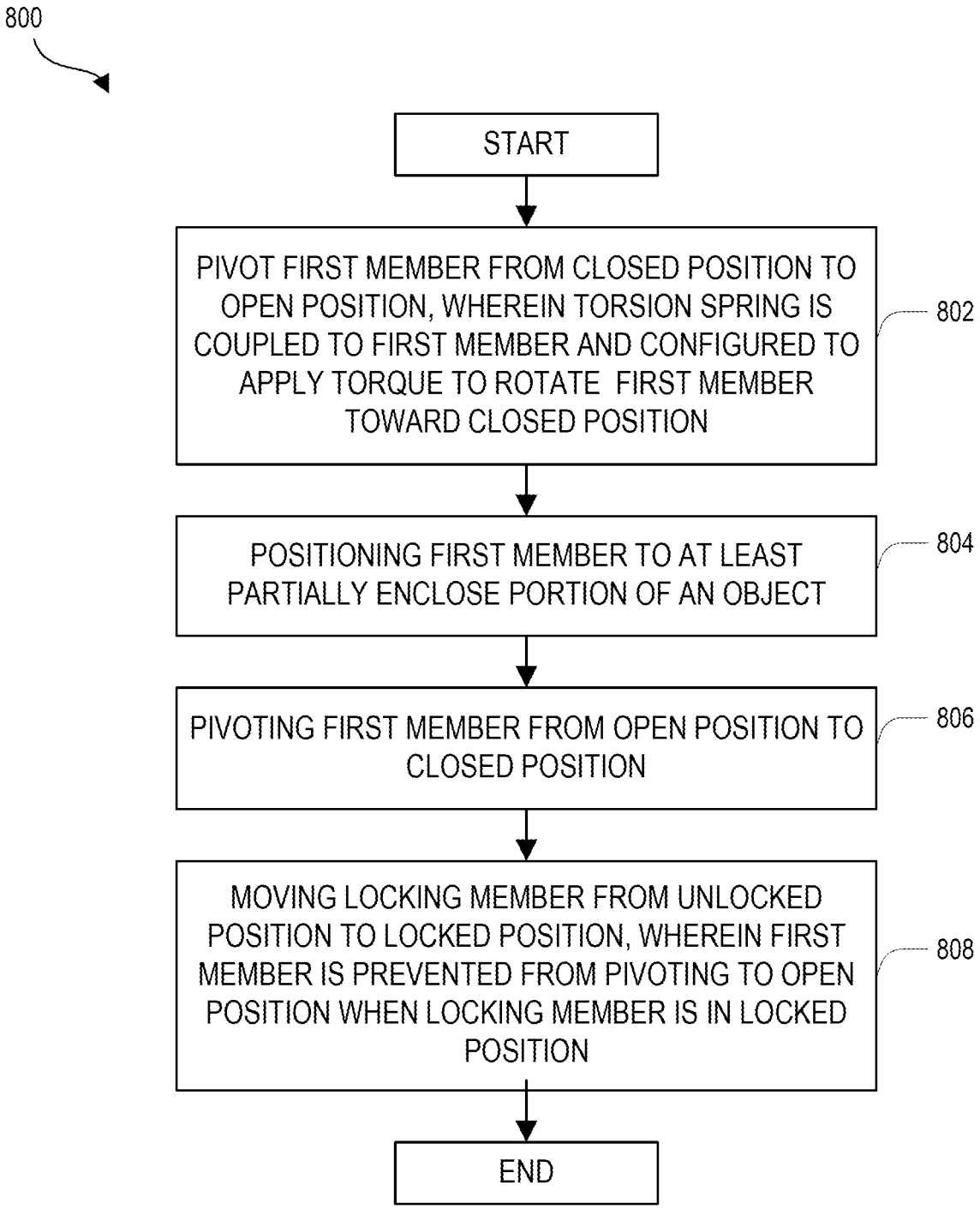
FIG. 8 is a flowchart of a method of securing an attachment clip.

Consistent with the systems and devices described herein, FIG. 8 depicts a method 800 of securing an attachment clip. At 802, a first member is pivoted from a closed position to an open position. A torsion spring may be coupled to the first member and configured to apply a torque to rotate the first member toward the closed position. At 804, the first member is positioned to at least partially enclose a portion of an object. At 806, the first member is pivoted from the open position to the closed position. At 808, a locking member is moved from an unlocked position to a locked position. The first member may be prevented from pivoting to the open position when the locking member is in a locked position.

The attachment clips and the associated electronics devices described herein may be specifically configured to pass various temperature, pressure, and mechanical tests. As discussed above, emergency responder communication devices in particular are often subjected to high temperatures. Accordingly, the electronics devices described herein may be constructed using particular materials and design techniques to remain functional in extreme conditions. For instance, the contact regions of the attachment clips described herein may be formed of a polymeric material, in order to prevent potential burns resulting from a user contacting a metallic material. In particular, the attachment clip may be formed of polyether ether ketone (PEEK), treated nylon, or a comparable heat-resistant polymer. The materials used to form the attachment clip may be specifically configured to maintain their original shapes when subjected to temperatures above at least 200 degrees Fahrenheit for at least 10 minutes. The attachment clips and the associated electronics devices may specifically be configured satisfy the heat and immersion requirements outlined in the NFPA 1802, Section 8.3 and/or the water drainage requirements outlined in NFPA 1802 (2021 Edition), Section 8.13.

While the disclosure has been described in detail and with reference to specific embodiments thereof, it will be apparent to one skilled in the art that various changes and modifications can be made therein without departing from the spirit of the embodiments. Thus, it is intended that the present disclosure cover the modifications and variations of this disclosure provided they come within the scope of the appended claims and their equivalents.

It is claimed:

1. An attachment clip comprising:

a first member configured to pivot on an axis between a closed position and an open position;

a first spring coupled to the first member and configured to apply a torque to rotate the first member toward the closed position;

a locking member coupled to the first member and configured to move from an unlocked position to a locked position when the first member is in the closed position, the first member being prevented from pivoting to the open position when the locking member is in the locked position; and a second spring coupled to the locking member and configured to apply a force to bias the locking member to the locked position.

2. The attachment clip of claim 1, wherein the locking member is configured to rotate from the unlocked position to the locked position.

3. The attachment clip of claim 2, wherein the second spring is configured to apply a torque to rotate the locking member toward the locked position.

4. The attachment clip of claim 1, further comprising:

a second member coupled to the first spring, wherein the first member is configured to pivot away from the second member when moving from the closed position to the open position.

5. The attachment clip of claim 4, wherein the locking member is configured to latch to the second member when in the locked position.

6. The attachment clip of claim 4, wherein the locking member is configured to slide from the unlocked position to the locked position.

7. The attachment clip of claim 6, wherein the second spring is a compression spring configured to apply a force to slide the locking member toward the locked position.

8. The attachment clip of claim 4, wherein the second member is configured to attach to an electronics device.

9. The attachment clip of claim 8, wherein the second member includes at least one aperture aligned with an aperture of the electronics device and configured to receive a fastener.

10. The attachment clip of claim 1, wherein the first member has a width that is parallel to the axis and a length extending from a first end to a second end, and wherein the ratio of the average width to the average length of the first member is less than 3:1.

11. The attachment clip of claim 1, wherein the attachment clip is configured to apply at least a 10 pound clamping force.

12. The attachment clip of claim 1, wherein the first member includes a gripping member configured to secure an object when the first member is in the closed position.

13. The attachment clip of claim 12, wherein the gripping member includes a hook having a curvature of at least 120 degrees.

14. An attachment clip comprising:

a first member having a first end and a second end, the first member configured to pivot on an axis between a closed position and an open position;

a spring coupled to the first member and configured to apply a torque to rotate the first member toward the closed position;

a second member, the second member including a protrusion having a bottom surface;

a locking member coupled to the second end of the first member and configured to slide from an unlocked position to a locked position, wherein the locking member includes a locking protrusion with a top surface, and wherein the top surface of the locking protrusion is opposed to the bottom surface of the protrusion of the second member when the locking member is in the locked position.

15. The attachment clip of claim 14, wherein the locking member includes a compression spring configured to apply a force to slide the locking member toward the locked position.

16. The attachment clip of claim 14, wherein the locking member partially extends past the second end of the first member, and wherein the locking member includes a receiving surface configured to guide a contacted object between the first member and the second member.

17. The attachment clip of claim 16, wherein the receiving surface has an angle of less than 60 degrees relative to a top surface of the first member.

* * * * *